US007995321B2

(12) United States Patent
Shimada

(10) Patent No.: US 7,995,321 B2
(45) Date of Patent: Aug. 9, 2011

(54) IONIZATION DEVICE

(75) Inventor: Tomonori Shimada, Hyogo (JP)

(73) Assignee: Keyence Corporation, Osaka (JP)

( * ) Notice: Subject to any disclaimer, the term of this patent is extended or adjusted under 35 U.S.C. 154(b) by 526 days.

(21) Appl. No.: 11/987,334

(22) Filed: Nov. 29, 2007

(65) Prior Publication Data

US 2008/0130190 A1 Jun. 5, 2008

(30) Foreign Application Priority Data

Nov. 30, 2006 (JP) ..... 2006-323596

(51) Int. Cl.
*H01T 23/00* (2006.01)

(52) U.S. Cl. ..... 361/231

(58) Field of Classification Search ..... 361/212, 361/213, 225, 229, 230, 231; 250/424
See application file for complete search history.

(56) References Cited

U.S. PATENT DOCUMENTS 6,653,638 B2 * 11/2003 Fujii ..... 250/423 R
6,744,617 B2 * 6/2004 Fujii ..... 361/231
2006/0193100 A1 * 8/2006 Izaki et al. ..... 361/220

* cited by examiner

*Primary Examiner* — Jared J Fureman
*Assistant Examiner* — Christopher J Clark
(74) *Attorney, Agent, or Firm* — Smith Patent Office

(57) ABSTRACT

An ionization device with increased rigidity of a coupling portion is provided. The ionization device includes a casing member for applying high voltage to each needle electrode; a coupling member for mechanically coupling a plurality of casing members in a longitudinal direction and electrically connecting high voltage plates of the respective casing members; and a elongated main body casing for housing a casing body constituted by coupling the plurality of casing members with the coupling member and the electrical circuit unit, the main body casing having the needle electrodes with a space from each other in the longitudinal direction and protruding outside. The main body casing integrally forms a space for arranging the casing body therein so as to be separated from a space for arranging the electrical circuit unit. With this configuration, the casing body to be applied with the high voltage is separated from the electrical circuit unit including a portion having low voltage, thereby avoiding unnecessary discharge.

17 Claims, 33 Drawing Sheets

Prior Art

Prior Art

Prior Art

Prior Art

Prior Art

IONIZATION DEVICE

BACKGROUND OF THE INVENTION

1. Field of the Invention

The present invention relates to an ionization device for removing electricity charge in a charged body that is either positively or negatively charged.

2. Description of the Related Art

Static electricity removal (removal of electricity), such as cleanup in a clean room and prevention of static charge of suspended particulates, is performed in order to control static electricity in the air, and corona discharge ionization devices are widely used for removing electricity in a noncontact manner.

A typical corona discharge electricity removing device causes corona discharge by applying either high voltage direct current or high voltage alternate current from a high voltage source to a needle electrode for discharge. FIG. 23 shows a schematic view of such an electricity removing device. The electricity removing device shown in this figure is provided with a discharge electrode 1 for causing corona discharge, a high voltage power supply unit 2 connected to an alternate current source, and a coupling capacitor 3 connecting the discharge electrode 1 with the high voltage power supply unit 2. The electricity removing device drives a high voltage transformer 2A which is the high voltage power supply unit 2 using alternate current source and applies high voltage to the discharge electrode 1 to cause corona discharge. The air surrounding the discharge electrode 1 is ionized due to the corona discharge, thereby generating either plus or minus ions. The ions in the ionized air are carried to an object item by blown with air by such as a fan provided for the electricity removing device. By neutralizing potential of the charged electricity of the object item with positive ions and negative ions, the electrical charge accumulated on the object item becomes closer to zero and removed.

A positive or negative ion flow generated by the electricity removing device and flowing in the air can be considered as current between a high voltage source and a ground. That is, the current flowing from the high voltage source to the ground corresponds to the negative ion flow, and the current flowing from the ground to the high voltage generating unit corresponds to the positive ion flow. As a result of such an interaction between the ion flow and the current, when an amount of positive ions generated by the electricity removing device equals to an amount of negative ions by the electricity removing device, the current is neutralized and amounts to zero. Therefore, by maintaining a balance between the amounts of the generated positive and negative ions, the electricity removing device can correctly perform removal of electricity.

For example, a so-called bar-type electricity remover has been known as a conventional ionization device as shown in FIG. 24 to FIG. 27. FIG. 24 to FIG. 27 show an ionization device; FIG. 24 is a perspective view illustrating an appearance of the ionization device, FIG. 25 is an exploded perspective view, FIG. 26 is a cross-sectional view, and FIG. 27 is a block diagram. The ionization device illustrated by these drawings is constituted by a discharge electrode bar. Such as a high voltage unit 213 is provided in an upper area within a main body casing 10, and an air supply unit 211 supplying air that carries ions is provided in a lower area of the main body casing 10. When an electrode assembly 236 is mounted to the air supply unit 211, a cutting contact segment 259 of a high voltage plate 258 is brought into contact with an upper end surface of a needle electrode 212. An area including a contact portion of the needle electrode 212 and the cutting contact segment 259 forms an enclosed space in the air supply unit 211, that is an enclosed space S2 isolated and independent from a main air channel S1 and a cylindrical branch air channel 245, by a tip end portion of a tubular portion with smaller inner diameter 240 of an electrode assembly 236 fitting into a first sleeve 229 of a supporting plate.

Patent Document 1: Japanese Unexamined Patent Publication No. 2002-216996

Different capabilities for removing electricity are required depending on an environment in which the electricity removing device is used. Specifically, the number of discharge electrodes is determined for each area from which electricity is required to be removed. However, providing separate discharge electrode bars for different areas with different numbers of required discharge electrodes poses problems such as requiring respective new designs and increase in cost. Therefore, providing an electricity removing device having the desired number of discharge electrodes by coupling a plurality of discharge electrode bars having several discharge electrodes is commonly employed.

However, the conventional discharge electrode bar is relatively heavy in weight because many metal components are used, and thus, a mechanical reinforcement is required to some extent in order to maintain strength at a coupling portion. In order to maintain the strength, it is necessary to use such as an additional metal component for a coupling member, resulting in a problem that an increased size and weight of an entire device.

One conceivable way to address the above problems is to reinforce a coupling structure. However, when rigidity of the main body casing is not sufficient, this method is insufficient and the main body casing itself is required to be reinforced with metal. This can cause increase in length and weight of the casing. In recent years, especially, a demand for an ionization device provided with an increased number of discharge electrodes and improved capability of electricity removal that can be applied to a large-scale apparatus is increasing. Further, because a supply channel for air that carries charged ions also becomes longer when the ionization device becomes longer, it becomes difficult to supply air sufficiently and evenly to each discharge electrode along the length. Moreover, there is a problem in securing safety.

SUMMARY OF THE INVENTION

The present invention is contrived in order to address to the above noted problems. A main object of the present invention is to provide an ionization device with increased rigidity at a coupling portion.

In order to achieve the above object, an ionization device according to a first aspect of the present invention includes a plurality of needle electrodes each for emitting ions charged either positively or negatively from a tip end thereof by applying high voltage thereto, an electrical circuit unit for applying the high voltage to the needle electrodes, casing members each formed in a elongated unit, having a high voltage plate for receiving power supply from the electrical circuit unit, and attachable with the plurality of the needle electrodes with a space from each other, the casing members for applying the high voltage supplied from the electrical circuit unit via the high voltage plate to the respective needle electrodes, a coupling member for mechanically coupling the plurality of casing members in a longitudinal direction and electrically connecting the high voltage plates of the respective casing members, and an elongated main body casing for housing a casing body constituted by coupling the plurality of casing members with the coupling member and the electrical circuit unit, the main body having the needle electrodes while spaced from each other in the longitudinal direction and protruding outside, wherein the main body casing integrally forms a space for arranging therein the casing body so as to be separated from a space for arranging the electrical circuit unit. With this configuration, the casing body to be applied with the high voltage can be separated from the electrical circuit unit including a portion having low voltage, thereby avoiding unnecessary discharge.

The ionization device according to a second aspect of the present invention may be configured such that the main body casing is divided into a first casing and a second casing, the first casing includes an integrally formed portion having a square cross-section with one side open, and a first wall surface integrally extending from one end of a rear surface of the portion having the square cross-section with one side open, the second casing is includes a second wall surface in contact with the rear surface of the portion having the square cross-section with one side open, and in contact with a tip end of the first wall surface, and in a state in which the first casing and the second casing are fitted together, the casing body is arranged in a first space defined by the portion having the square cross-section with one side open, and the electrical circuit unit is arranged in a second space defined by the rear surface of the portion having the square cross-section with one side open, the first wall surface, and an inner side of the second wall surface. With this configuration, the ionization device extended by the integrally formed portion having the square cross-section with one side open in the longitudinal direction can exhibit sufficient rigidity in a length direction thereof. Further, by partitioning the casing body with the portion having the square cross-section with one side open, a creeping discharge route due to a potential difference between the casing body to be applied with the high voltage and the electrical circuit unit including a portion having low voltage can be made longer, thereby avoiding generation of creeping discharge.

The ionization device according to a third aspect of the present invention may be configured such that the casing member includes a carrier gas route for supplying carrier gas, in order to send from around the needle electrodes the carrier gas for carrying ions emitted from the needle electrodes, the main body casing includes a middle carrier gas piping for supplying the carrier gas to one or more casing members positioned at a middle portion in the main body casing, the carrier gas is supplied to the carrier gas route from an end portion of the main body casing for the casing members positioned at an end portion in the main body casing, and the carrier gas is supplied via the middle carrier gas piping to the casing members positioned at the middle portion of the main body casing. With this configuration, in the ionization device extended in the longitudinal direction by coupling the plurality of casing members, a possibility that carrier gas may not sufficiently supplied to the casing members positioned at the middle portion is avoided, thereby stably supplying the carrier gas to each casing member.

The ionization device according to a fourth aspect of the present invention may be configured such that the middle carrier gas piping is constituted by a hard pipe. With this configuration, by extending the hard pipe with high rigidity along the longitudinal direction in the main body casing, it is possible to contribute to rigidity reinforcement in the longitudinal direction in comparison with a rubber pipe.

The ionization device according to a fifth aspect of the present invention may be configured such that the coupling member is a joint for inserting and pulling the casing members to couple the same along the longitudinal direction of the main body casing. With this configuration, a dimension error of the casing member in the longitudinal direction can be adjusted by an amount of insertion into the joint.

The ionization device according to a sixth aspect of the present invention may be configured such that the joint is used to couple the casing members positioned at the middle portion in the main body casing, and includes a carrier gas supply joint for connecting the middle carrier gas piping. With this configuration, it is possible to achieve coupling between the casing members and connection of the middle carrier gas piping with a single joint, thereby promoting simplifying the configuration and laborsaving in assembly steps.

The ionization device according to a seventh aspect of the present invention may be configured such that the joint includes a power supply joint for connecting the high voltage generated by the electrical circuit unit to a high voltage plate included in the casing member. With this configuration, it is possible to achieve coupling between the casing members and supply of the high voltage with a single joint, thereby promoting simplifying the configuration and laborsaving in assembly steps.

The ionization device according to a eighth aspect of the present invention may further include a covering portion made of metal for covering an outer periphery of the main body casing, wherein the covering portion has a square cross-section with one side open and is integrally formed by extending along the longitudinal direction of the main body casing, the main body casing being inserted into an opening of the square with one side open, thereby elastically pressing and holding the main body casing. With this configuration, it is possible to cover the main body casing in the length direction with a metal plate having the square cross-section with one side open, thereby reinforcing the main body casing extended along the longitudinal direction.

The ionization device according to a ninth aspect of the present invention may be configured such that the electrical circuit unit is positioned at an end portion in the longitudinal direction in the main body casing. With this configuration, it is possible to achieve balanced arrangement and elimination of a dead space.

The ionization device according to a tenth aspect of the present invention may be configured such that the electrical circuit unit includes a power unit having a power supply circuit connected to an external power source and receiving power, a control unit having a control circuit, and a booster unit having a booster circuit for boosting voltage, each of which is constituted in a unit form. With this configuration, the power unit, control unit, and booster unit, each of which is constituted in a unit form, can be efficiently arranged in a limited space within the main body casing.

The ionization device according to a eleventh aspect of the present invention may be configured such that the electrical circuit unit is arranged at one end in the main body casing, and the middle carrier gas piping is arranged at the other end. With this configuration, balanced arrangement of the electrical circuit unit and the middle carrier gas piping in the space within the main body casing can be achieved, thereby efficiently utilizing the limited space without enlarging a size of the main body casing.

The ionization device according to a twelfth aspect of the present invention may be configured such that the main body casing has a length in a range from 1.0 m to 4.0 m. With this configuration, it is possible to configure a bar-type ionization device longer than a conventional ionization device.

DETAILED DESCRIPTION OF THE PREFERRED EMBODIMENTS

Figure 1:
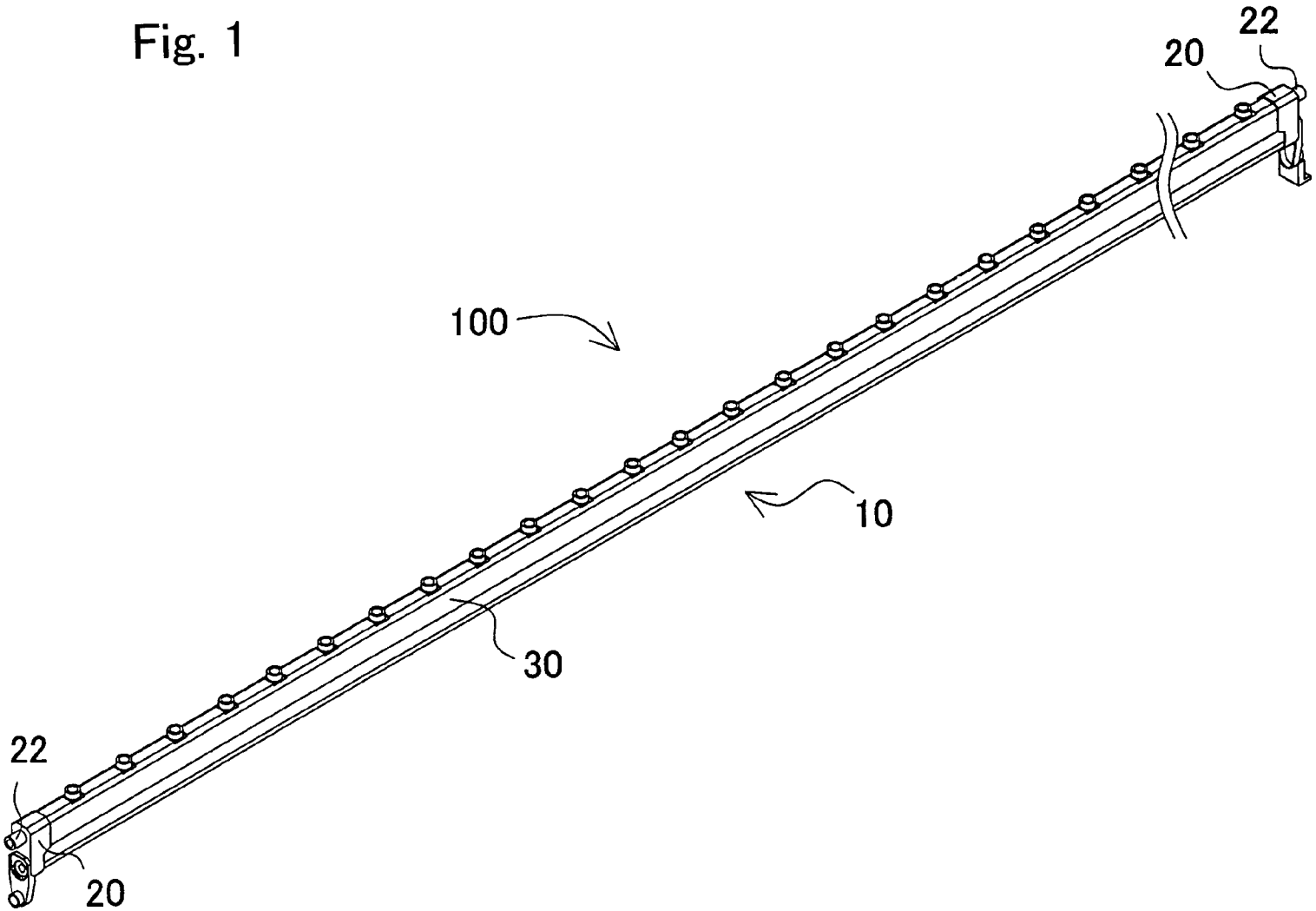
FIG. 1 shows a perspective view illustrating an ionization device of a first embodiment according to the present invention, viewed obliquely upward.

The following describes an embodiment of the present invention with reference to the drawings. The embodiment described below exemplifies an ionization device that embodies a technical concept of the present invention, and the present invention is not particularly limited to the ionization device as described in the following. Moreover, the present specification is not intended to limit components described in the scope of the claims to what described in the embodiment. In particular, such as a size, material, shape, and relative arrangement of the components of the present invention are not limited to ranges described herein as described in the embodiment, unless otherwise stated, and such ranges are illustrative purpose only. It should be noted that sizes of and positional relation between the components as shown in the drawings are not in scale. Further, in the following description, the like names and numerals respectively indicate the like components or components of the like material, and explanation for such components are omitted. Moreover, the components that constitute the present invention can be such that a plurality of components are formed by a single member so that the single member serves as the plurality of the components, or a function of a single component can be shared by a plurality of members.

First Embodiment

Figure 2:
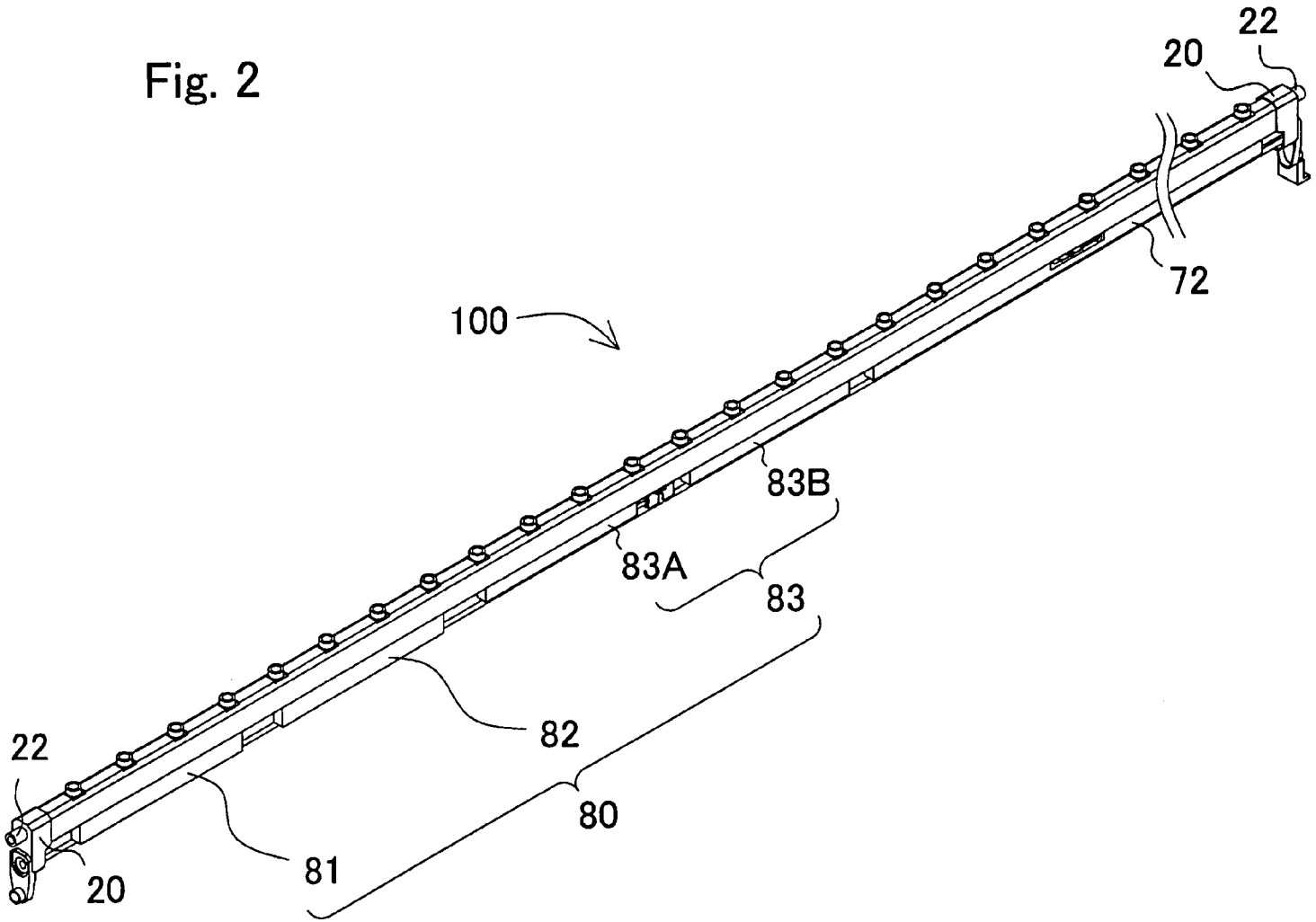
FIG. 2 shows a perspective view where a second casing is removed from the ionization device as shown in FIG. 1.
Figure 3:
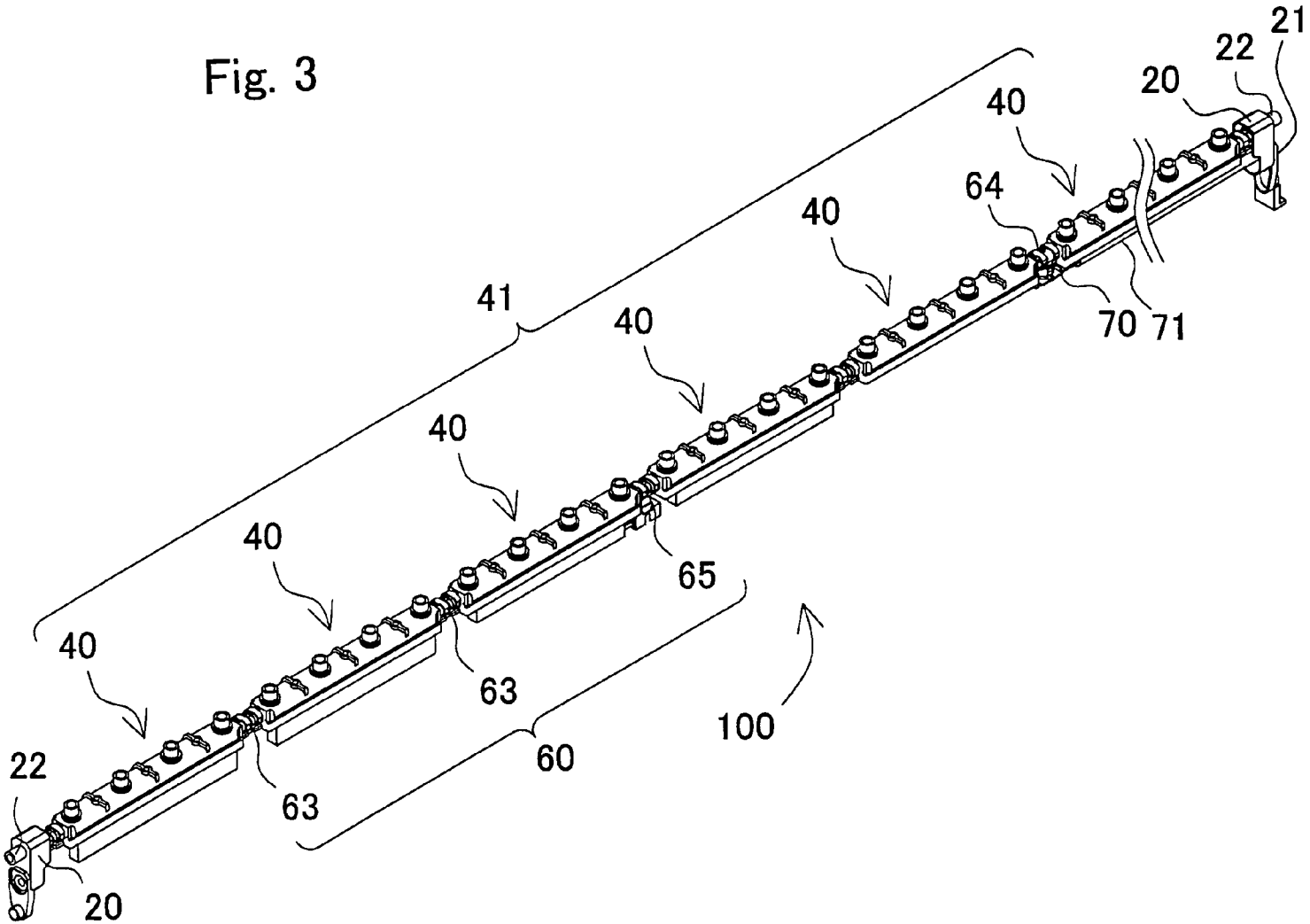
FIG. 3 shows a perspective view where a first casing, a covering portion and a reinforcement member are removed from the ionization device as shown in FIG. 2.
Figure 4:
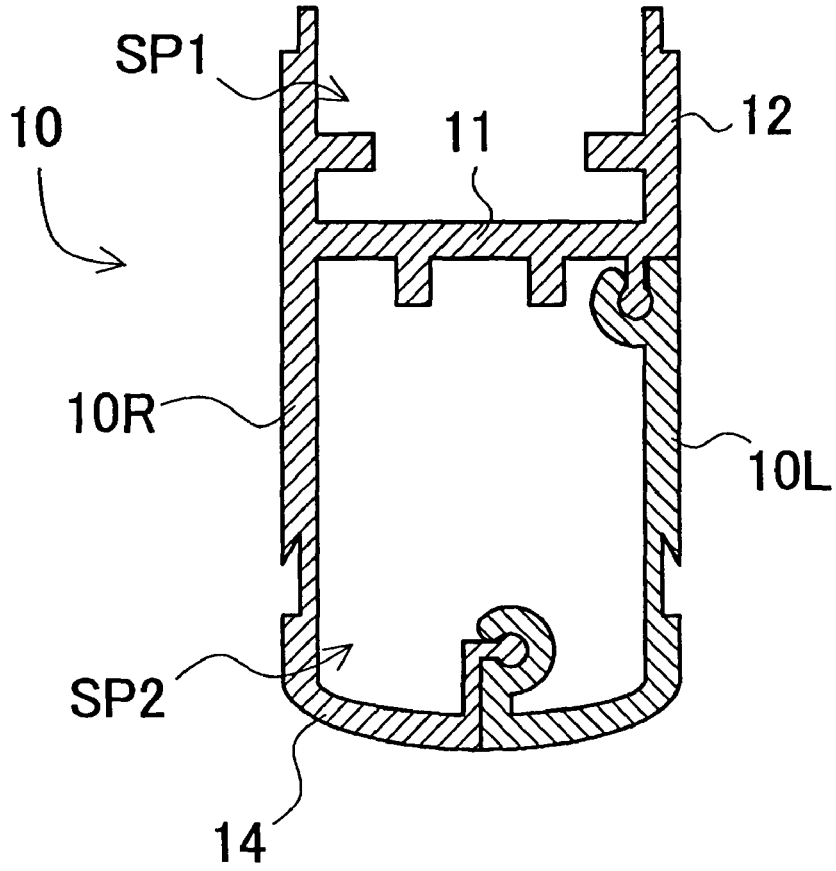
FIG. 4 shows a transverse sectional view of a main body casing.

FIG. 1 to FIG. 4 show an ionization device 100 of a first embodiment according to the present invention. FIG. 1 shows a perspective view illustrating an appearance the ionization device 100 viewed obliquely. FIG. 2 shows a perspective view where a second casing is removed from the ionization device 100 as shown in FIG. 1. FIG. 3 shows a perspective view where a first casing, a covering portion and a reinforcement member 72 are removed from the ionization device as shown in FIG. 2. FIG. 4 shows a transverse sectional view of a main body. In these figures, objects are shown in a state in which a needle electrode 90 is on the upper side for explanation purpose, as opposed to a state they are actually used.

The ionization device 100 as shown in FIG. 1 constitutes a bar-type electricity remover having a controller built-in, so-called a discharge electrode bar. This ionization device 100 is provided with a main body casing 10 extended in an elongate shape, and side covers 20 that respectively block both end surfaces of the main body casing 10. A lower surface of the main body casing 10 (upper surface in FIG. 1) has an opening 31, into which the needle electrode 90 that emits ions protrudes. Further, the lower surface of the main body casing 10 is covered and reinforced with a covering portion 30.

(Main Body Casing 10)

As shown in FIG. 3, a casing body 41 in which ten casing members 40 are coupled therein is housed in the main body casing 10. In order to secure rigidity in a length direction, the main body casing 10 as shown in FIG. 1 is formed by an extruded material as a single piece without any joint in the length direction. In this example, a length of the main body casing 10 including the side cover 20 can be from 1.0 m to 4.0 m. In this embodiment, a total length of the ionization device 100 is set to be 3 m.

In order to provide an insulating property, the main body casing 10 is constituted by an insulating material such as resin, rather than a conductive member such as metal. In this embodiment, the main body casing 10 is formed by a resin extruded material. With this configuration, the main body casing 10 can be provided with an insulating property and reduced in weight. On the other hand, because the main body casing 10 is extended into the elongated shape, the main body casing 10 is integrally formed in the length direction without a joint, has a square cross-section with one side open as described later, and is covered with the covering portion 30 made of metal and having a square cross-section with one side open, in order to achieve sufficient strength without using metal (details will be described later). An external shape of the main body casing 10 is preferably such that a cross section of the main body casing 10 becomes an inverted U shape. With this configuration, it is possible to suppress generation of turbulence in an air flow that flows downward of an atmosphere around the ionization device.

(Covering Portion 30)

Figure 21:
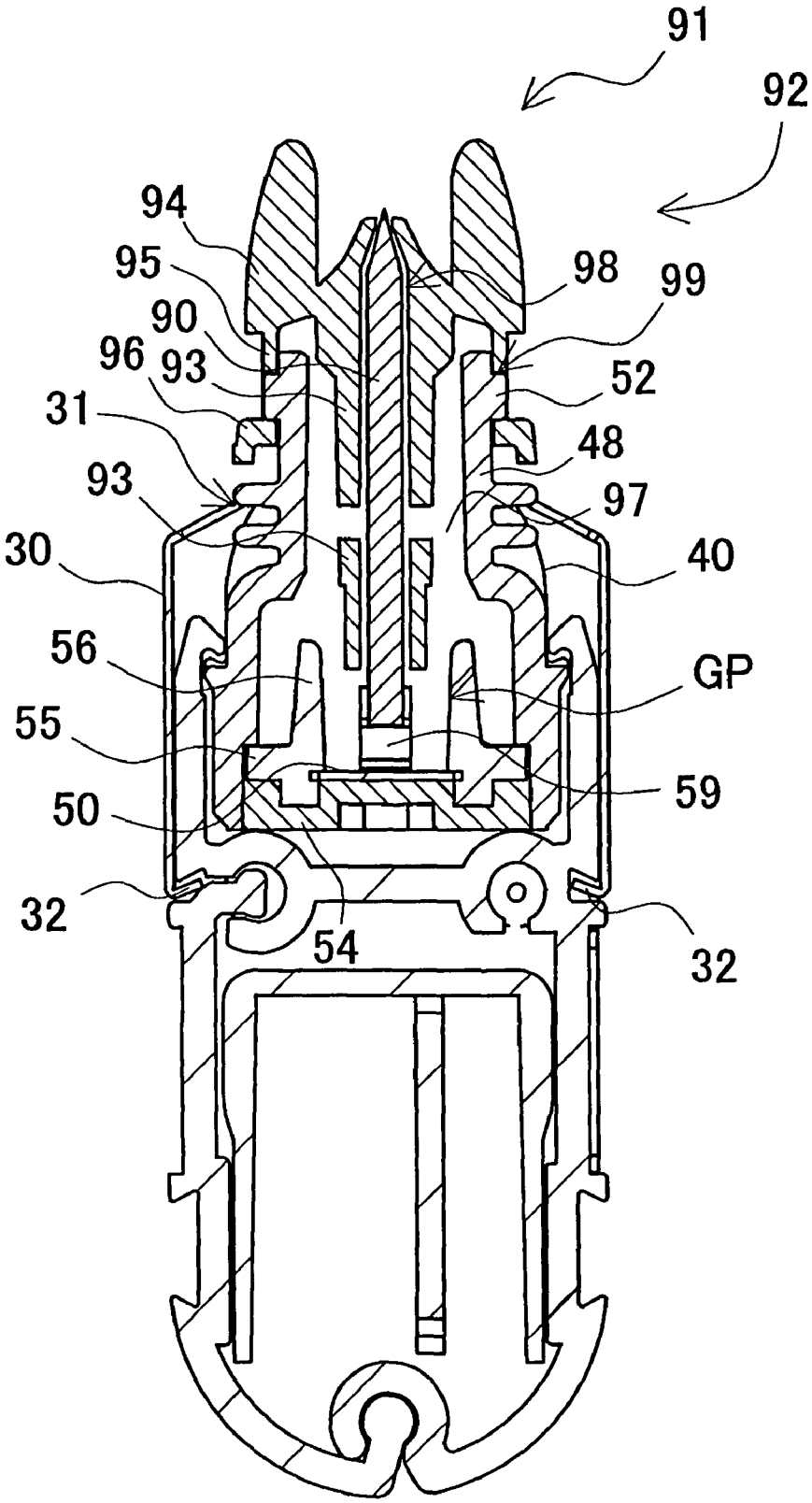
FIG. 21 shows a transverse sectional view of a portion of the ionization device at which a needle electrode is provided.

By covering the lower surface of the main body casing 10 with the covering portion 30 made of metal, the strength in a longitudinal direction is reinforced. The covering portion 30 is made of a metal plate as shown in FIG. 2 and FIG. 21 that is later described, and is integrally formed with a square cross-section with one side open along the longitudinal direction of the main body casing 10. The main body casing 10 is inserted into an opening of the square with one side open and elastically presses and holds the main body casing 10. Further, a turn-up piece 32 is formed at an edge of the opening of the square with one side open, and the covering portion 30 is fitted to the main body casing 10 by inserting the turn-up piece 32 into a slit provided for a side surface of the main body casing 10. The covering portion 30 is preferably a metal plate made of such as stainless steel, aluminum, or titanium. Moreover, the covering portion 30 is provided with the opening 31 opening at a portion corresponding to a position at which the needle electrode 90 is provided, in order to have the needle electrode 90 protrude outside. By grounding the covering portion 30 to form a ground plate, a counter electrode plate of the needle electrode 90 that protrudes from the opening 31 is formed.

(Upper Space and Lower Space)

FIG. 4 shows a transverse sectional view of the main body casing 10. A base plate 11 is provided within the main body casing 10, and the base plate 11 vertically partitions a space inside the main body casing 10. The base plate 11 partitions the space inside the main body casing 10 into a first space SP1 and a second space SP2. A casing member 40 is housed within the first space SP1, that is, an upper space, and an electrical circuit unit 80 for generating heat is housed within the second space SP2, that is, a lower space. With this configuration, even when a protective material or filling material, for example, within the main body casing 10 is gasified, it is possible to suppress outflow of the gasified material into the lower space. Preferably, the electrical circuit unit 80 is enclosed in a sealed space.

(Right Fragment Casing and Left Fragment Casing)

The main body casing that constitutes the ionization device generally has an elongated inverted U-shaped cross section. An upper end (lower end in the drawing) of the main body casing has a cross-section that is relatively smoothly curved. The main body casing includes a side wall that extends substantially perpendicularly from this upper end. Further, as shown in FIG. 4, the main body casing 10 is partitioned along the length direction into a right fragment casing 10R as a first casing and a left fragment casing 10L as a second casing. The right fragment casing 10R is formed to have a square cross-section with one side open with a perpendicular wall surface 12 folded downward from both ends of the base plate 11 (upward in FIG. 4), and, a first folded wall surface 14 as a first wall surface that is extended linearly from one end of a real side of the base plate 11 and whose tip end is folded is integrally formed. The casing member 40 in which a supporting plate 55 holding a high voltage plate 50 that is later described is insert molded is housed in the first space SP1 partitioned by a portion having a square cross-section with one side open. In this manner, by enclosing a high voltage member from three directions by an integrally formed partition wall, a high voltage member is isolated and insulated.

On the other hand, the left fragment casing 10L is formed on a second wall surface as a second folded wall surface, as shown in FIG. 4, that is brought into contact with the rear side of the base plate 11 that is an opposite side of a portion where the first folded wall surface 14 is provided, and is brought into contact with a tip end of the first folded wall surface 14. A shape of the left fragment casing 10L corresponds to a shape of the right fragment casing 10R that forms the perpendicular wall surface 12, as shown in FIG. 4, and formed shorter by a length of the perpendicular wall surface 12 so as to be extended from the rear side of the base plate 11 of the right fragment casing 10R. The second space SP2 is formed with the left fragment casing 10L, the first folded wall surface 14, and the rear side of the base plate 11. The electrical circuit unit 80 that is later described is disposed in the second space SP2. Because the electrical circuit unit 80 includes a member having low voltage, a large potential difference is generated between the electrical circuit unit 80 and the high voltage plate 50. Accordingly, the electrical circuit unit 80 and the high voltage plate 50 are spatially separated with the base plate 11 to insulate. Furthermore, partitioning the first space SP1 with the base plate 11 makes a creepage distance between the high voltage plate 50 and the electrical circuit unit 80 longer, and thereby preventing creeping discharge.

Figure 28:
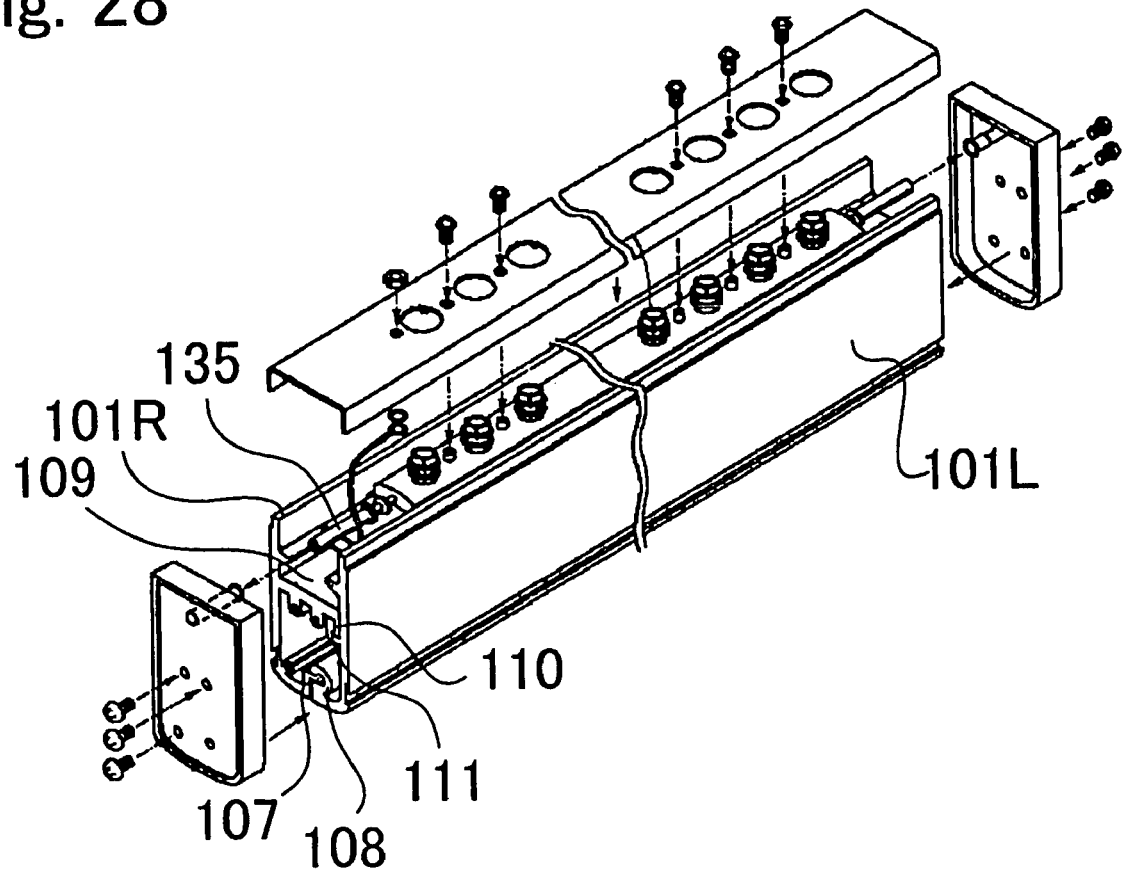
FIG. 28 shows an exploded perspective view illustrating a conventional electricity remover viewed obliquely upward.
Figure 29:
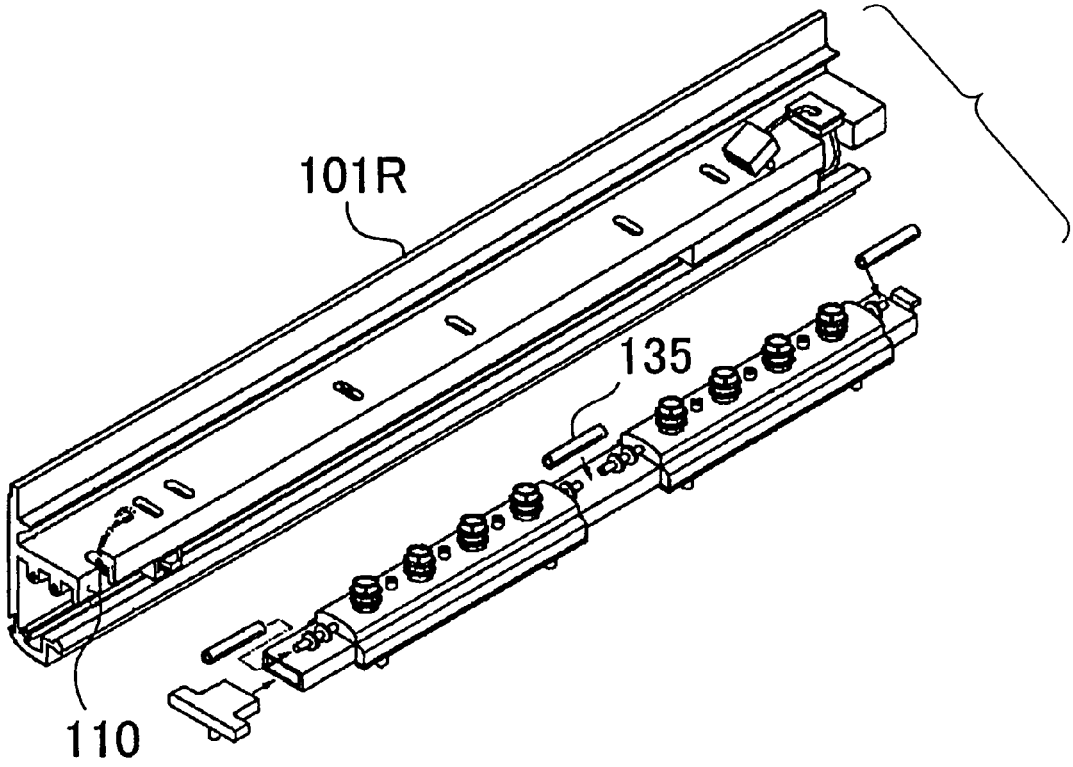
FIG. 29 shows an exploded perspective view of a right fragment casing portion in FIG. 28 viewed obliquely upward.
Figure 30:
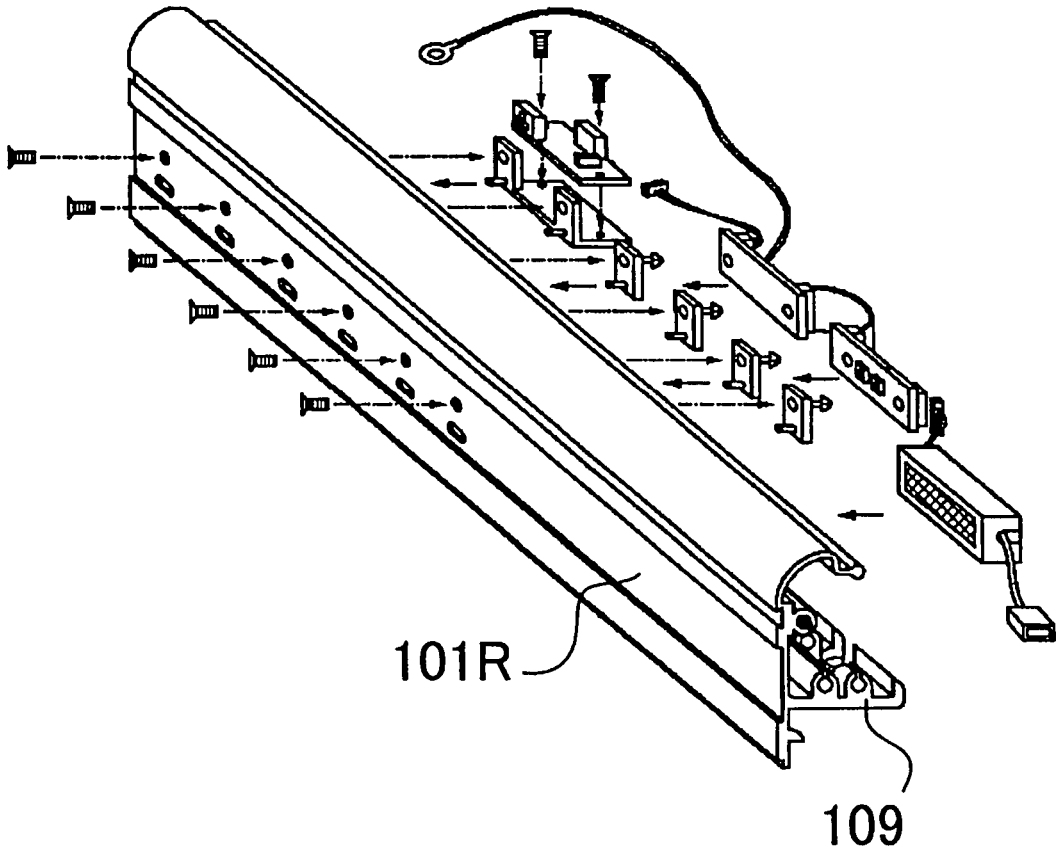
FIG. 30 shows an exploded perspective view of a right fragment casing portion in FIG. 28 viewed obliquely downward.
Figure 31:
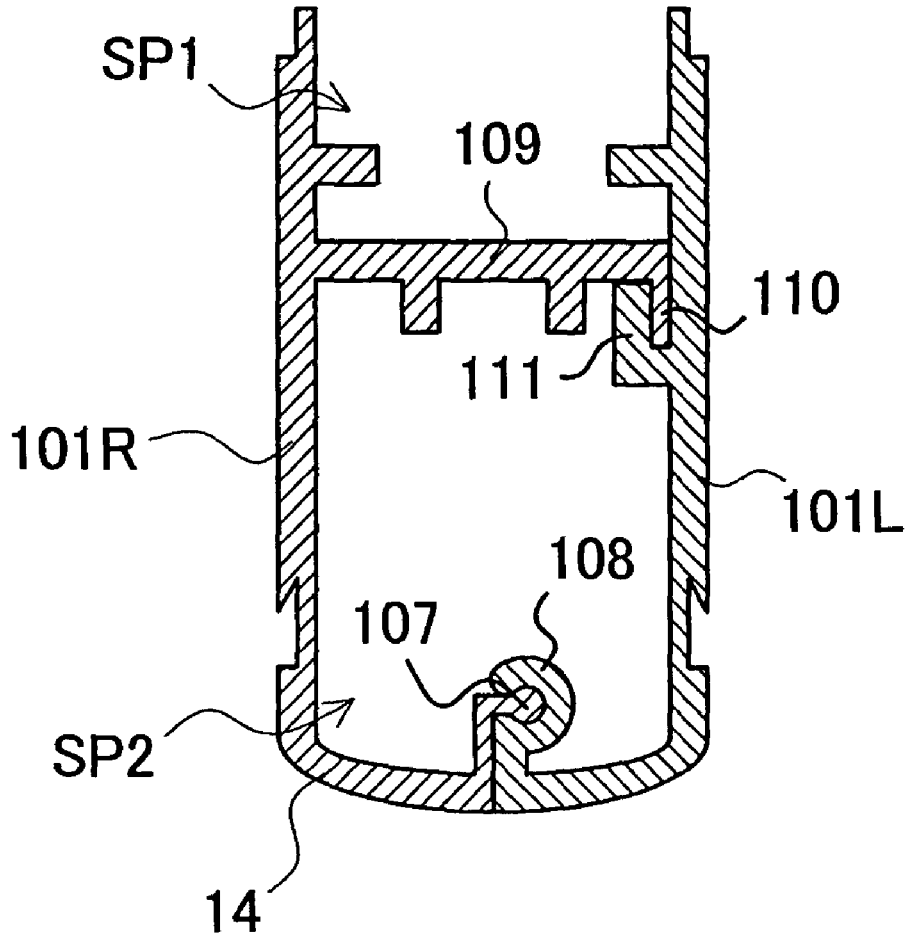
FIG. 31 shows a cross-sectional view illustrating a casing in FIG. 28.

Here, FIG. 28 to FIG. 31 show exploded perspective views of a conventional electricity removing device. In these figures, FIG. 28 shows an exploded perspective view illustrating the electricity remover viewed obliquely upward, FIG. 29 shows an exploded perspective view of a right fragment casing portion 101R in FIG. 28, FIG. 30 shows an exploded perspective view of the right fragment casing portion 101R viewed obliquely downward, and FIG. 31 shows a cross-sectional view illustrating the casing. Cross-sectional shapes of the right fragment casing portion 101R and a left fragment casing portion 101L are different. As shown in the cross-sectional view of FIG. 31, the right fragment casing portion 101R is formed to have an inverted F-shaped cross-section, and engaged with an inverted L-shaped left fragment casing portion 101L. Therefore, in the right fragment casing portion 101R is, as shown in FIG. 29, a base plate 109 that extends traversely or horizontally is integrally formed at the side wall along an entire length of the right fragment casing portion 101R. At an open end, i.e. a side end of the base plate 109 in a width direction, a flexed portion 110 that is flexed upward (downward in FIG. 29 and FIG. 30) by 90 degrees is formed. On the other hand, an L-shaped portion 111 is formed at the side wall portion of the left fragment casing portion 101L, and the L-shaped portion 111 extends along an entire length of the left fragment casing portion 101L. Further, upper ends of the right and left fragment casing portions 101L and 101R (lower end in the figures) can be slidably fitted. Specifically, in the casing shown in the drawings, an enlarged head 107 protruding traversely is formed at the upper end of the right fragment casing portion 101R (lower end in the figures). The enlarged head 107 is extended along the entire length of the right fragment casing portion 101R and along an edge of the upper end the right fragment casing portion 101R. A groove 108 is formed at an upper end of the left fragment casing portion 101L (lower end in the figures), and a shape of the groove 108 is corresponding to the shape of an outline of the enlarged head 107. The groove 108 extends along an edge of the upper end of the left fragment casing portion 101L in a longitudinal direction, and ends of the groove 108 are both open. The groove 108 can accept the enlarged head 107 with either of the both ends. For example, by inserting the enlarged head 107 from one end of the groove 108 and sliding the right and left fragment casing portions 101L and 101R along the longitudinal direction with respect to each other, the right and left fragment casing portions 101L and 101R are brought into an undetachable state, so as to form an inverted U-shaped cross-section with an opening toward a lower end (upper end in the figures).

In this configuration, while the strength at a T-shaped portion having the inverted F-shaped cross-section of the right fragment casing portion 101R is reinforced, the joint between the right fragment casing portion 101R and the left fragment casing portion 101L becomes weaker. Therefore, in this embodiment, as shown in FIG. 4, the tip end of the base plate 11 that constitutes the T-shaped portion of the right fragment casing 10R is further flexed and formed in a square with one side open with the perpendicular wall surface 12 that is protruded upwardly. By configuring the base plate 11 that is formed with the perpendicular wall surface 12 along the entire length of the right fragment casing 10R, it is possible to increase the rigidity of the casing along the entire length in the length direction, and to maintain sufficient strength even when the length of the casing is made longer. Especially, in this embodiment, it is possible to achieve better strength than a structure having the T-shaped cross-section, due to an extension of a rear surface of the square cross-section with one side open to form an inverted h shape.

Moreover, with this configuration, it is possible to suppress a risk of creeping discharge. Specifically, an interior of the main body casing 10 is partitioned by the base plate 11, and a high voltage route VP is disposed in the first space SP1 positioned at an upper side in FIG. 4, such as an electronic circuit is disposed in the second space SP2 at a lower side in FIG. 4. In a conventional configuration, as shown in FIG. 31, a gap is generated where an edge of a base plate 109 is brought into contact with the left fragment casing portion 101L, and a discharge route can be between high voltage of a discharge circuit disposed in the first space SP1 at the upper side from the gap, and low voltage portion of the second space SP2 at the lower side. In particular, because a large potential difference is generated between the high voltage of the discharge circuit disposed at the upper side and the low voltage portion, there is a risk of causing creeping discharge without taking a creepage distance sufficiently large. In contrast, in this embodiment, no gap is generated, as shown in FIG. 4, because the first space SP1 on the upper side is partitioned completely to have a square cross-section with one side open. As a result, it is possible to increase safety by making the creeping discharge route extremely long, because it is necessary to get over the perpendicular wall surface 12 to intrude into the lower portion in order to cause creeping discharge.

In this manner, by having a square cross-section with one side open that is integrally formed, it is possible to achieve sufficient rigidity along the length direction of the ionization device extended along the longitudinal direction. Furthermore, by partitioning the casing body with the base plate, it is possible to prevent creeping discharge by making the creeping discharge route due to the potential difference longer between the casing body to which the high voltage is applied and the electrical circuit unit 80 including the low voltage portion.

In addition, in the conventional electricity remover as shown in FIG. 31, because the L-shaped portion 111 and the flexed portion 110 are not completely adhered, a high voltage plate discharges through the gap to damage a power supply circuit, a control circuit, and such that are inside. In order to avoid such a problem, it is conventionally necessary to cover a joint portion with such as a tape.

Further, when the electricity remover becomes longer, bending is caused in the longitudinal direction, and then, the adhesiveness between the L-shaped portion 111 and the flexed portion 110 decreases and the possibility of causing discharge further increases. When the bending becomes greater, problems in which a contact between a needle electrode and a high voltage plate cannot be guaranteed. Moreover, distances to an object item to be removed with electricity can be different at a supporting portion of the electricity remover and its middle portion. In the worst case, the needle electrode itself can directly cause discharge.

In order to avoid the above problems, a structure is required to be provided in which the middle portion is additionally supported in addition to the both ends of the electricity remover. In a case in which there is a limitation in a location for installation, there is another problem, for example, that it is necessary to newly provide a fixing point for a fixing member when there are only two points for fixing supporting member on the ceiling.

In order to avoid the above problems, as shown in FIG. 4, the perpendicular wall surface 12 is extended from the edge of the base plate 11 to integrally form the portion having the square cross-section with one side open so that the base plate 11 is completely partitioned into the upper and low portions, and the creepage distance is increased and rigidity is improved. As a result, even when the electricity removing device is made larger and longer, no new supporting member such as a middle supporting member is required, and the electricity removing device can be used stably.

(Casing Member 40)

Figure 5:
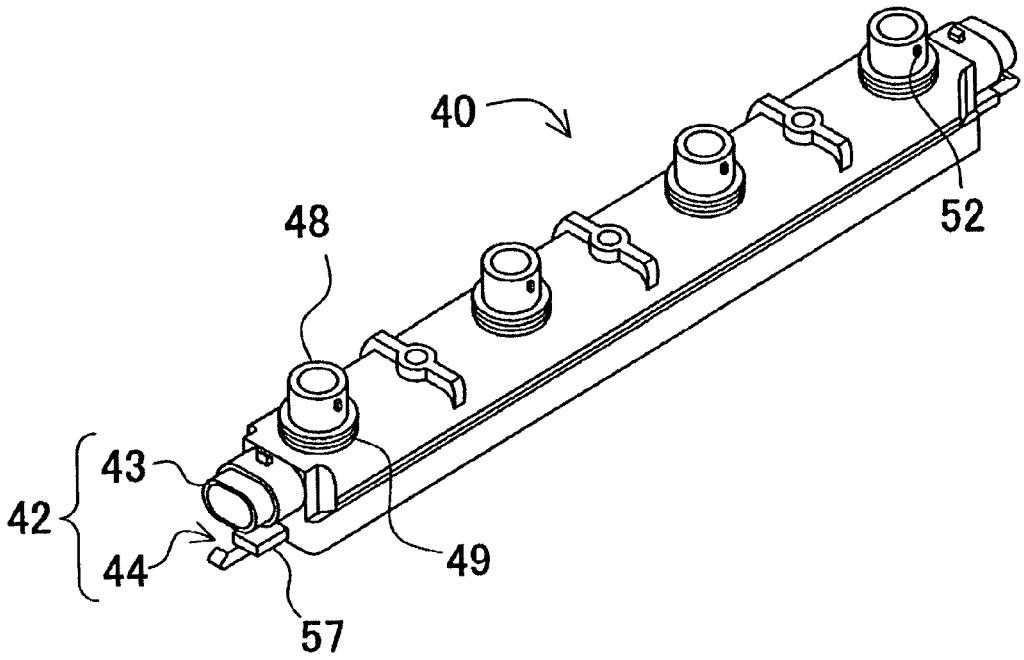
FIG. 5 shows a perspective view illustrating a casing member.

The casing member 40 is disposed in the first space SP1 partitioned by the base plate 11 within the main body casing 10. Ten pieces of casing members 40 that are coupled by a coupling member 60 constitute a single the casing body 41, as shown in FIG. 3. FIG. 5 shows a perspective view illustrating the casing member 40. As shown in the figure, each casing member 40 is provided with four needle electrodes 90. Accordingly, a number of the needle electrodes 90 provided for the ionization device 100 as shown in FIG. 3 is 90. In this manner, the plurality of casing members 40 are coupled additionally in the main body casing 10 of the ionization device 100, and the main body casing 10 that surrounds the casing members 40 is formed in a single member having a length corresponding to the number of the casing members 40. With this, it is possible to easily constitute ionization devices with different numbers of the needle electrodes or different length, while maintaining the strength at the coupling portion between the casing members 40, by standardizing the casing members 40 disposed within the main body casing 10.

The casing member 40 is formed by a resin having excellent electric properties such as pressure resistance, tracking resistance, and dielectric constant. Further, an insertion portion 57 is protruding from an edge of the casing member 40, and the insertion portion 57 is provided with an internal gas port 43 communicating with a carrier gas route GP and the high voltage plate 50 as a high voltage port 44.

Figure 6:
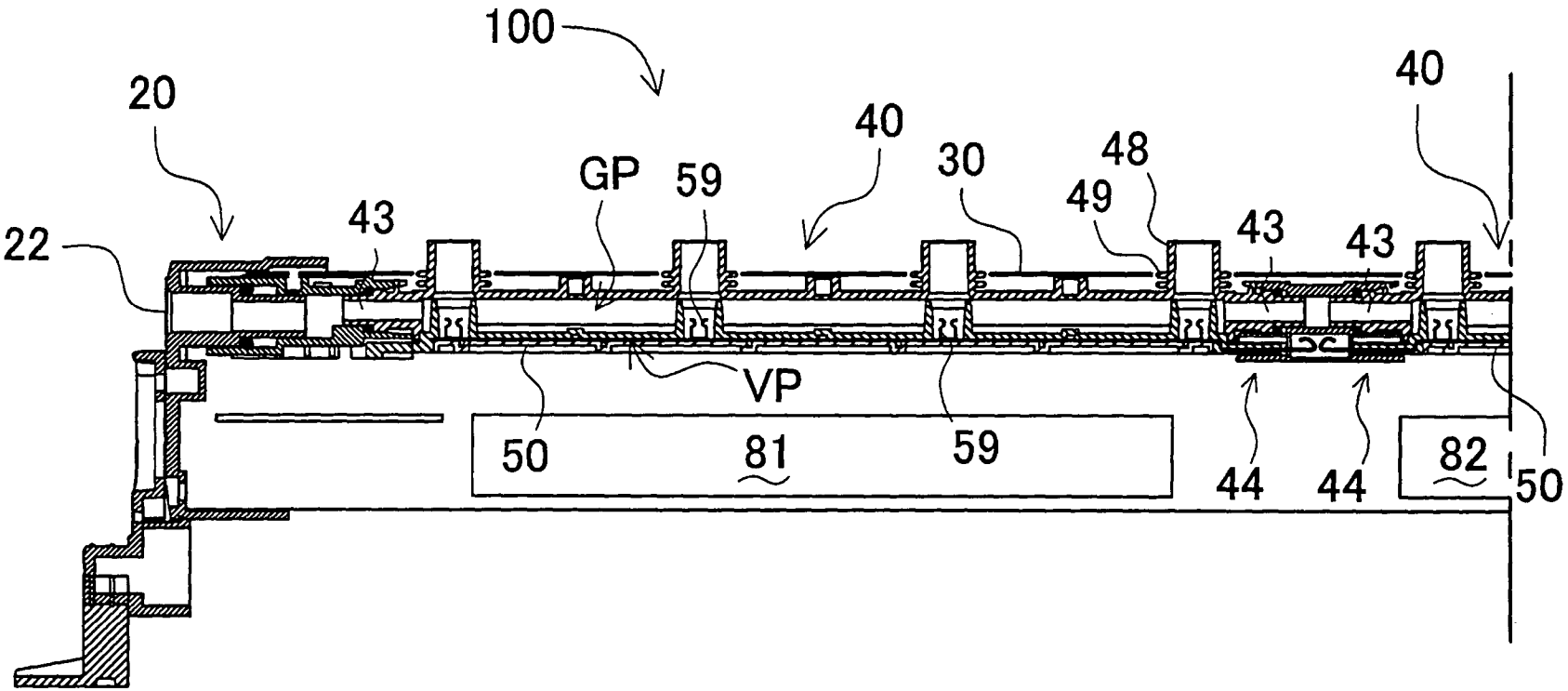
FIG. 6 shows a cross-sectional view illustrating the vicinity of one end of the ionization device.
Figure 7:
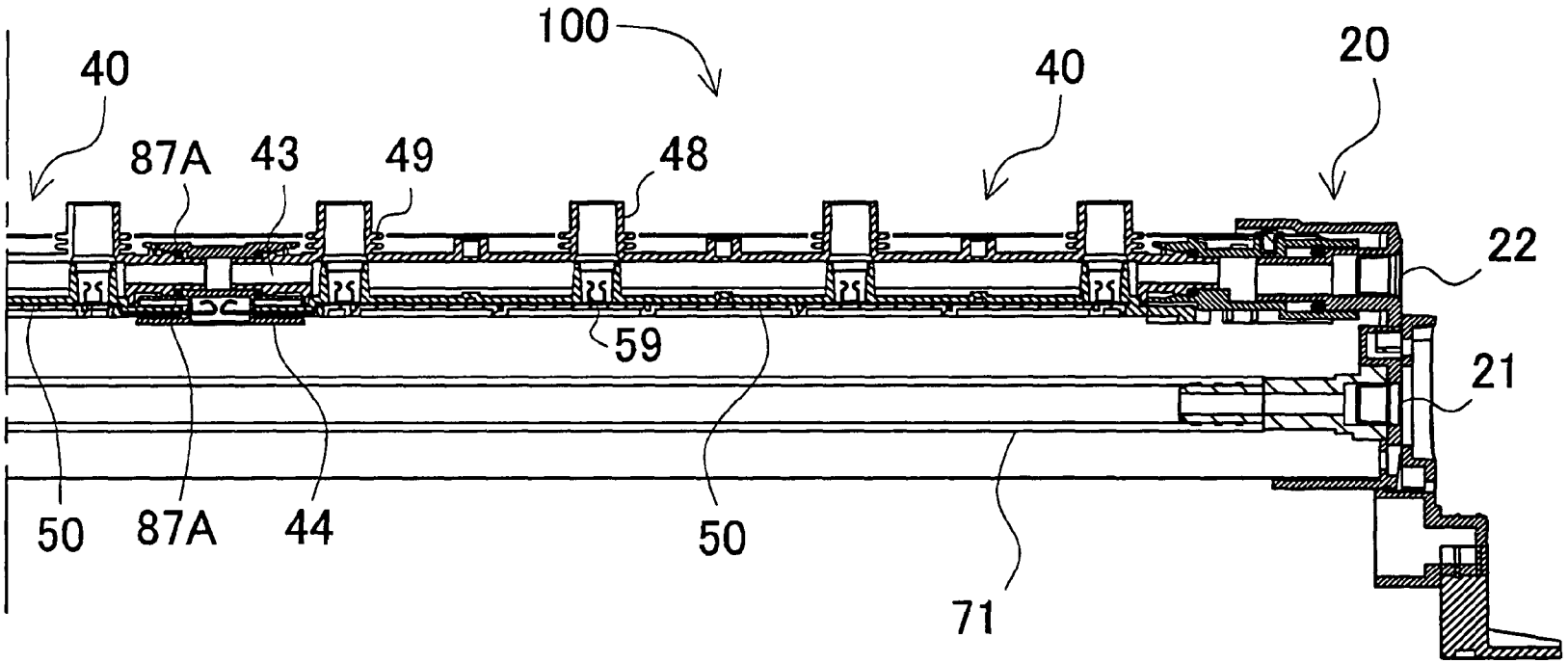
FIG. 7 shows a cross-sectional view illustrating the vicinity of the other end of the ionization device.
Figure 8:
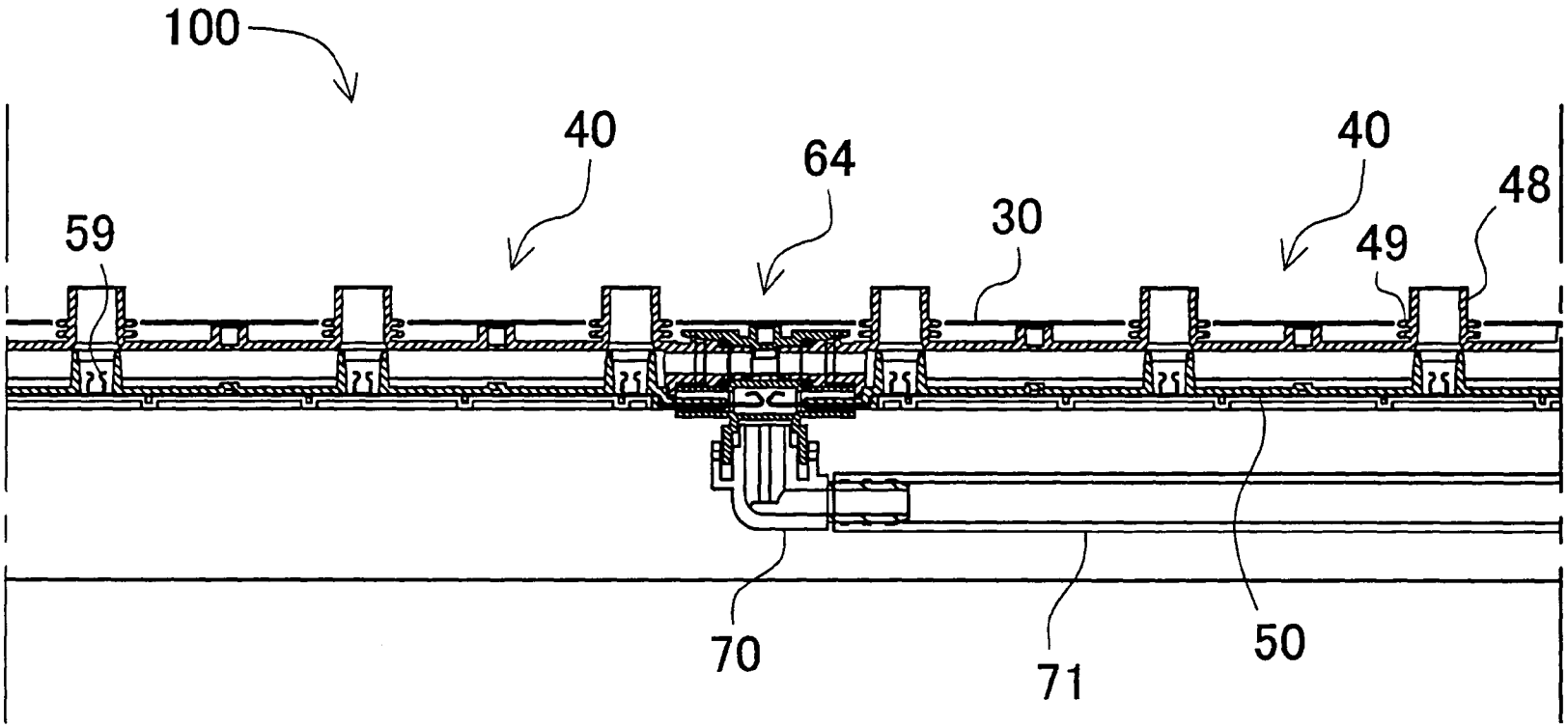
FIG. 8 shows a cross-sectional view illustrating the vicinity of a carrier gas supply joint in the middle of the ionization device.
Figure 9:
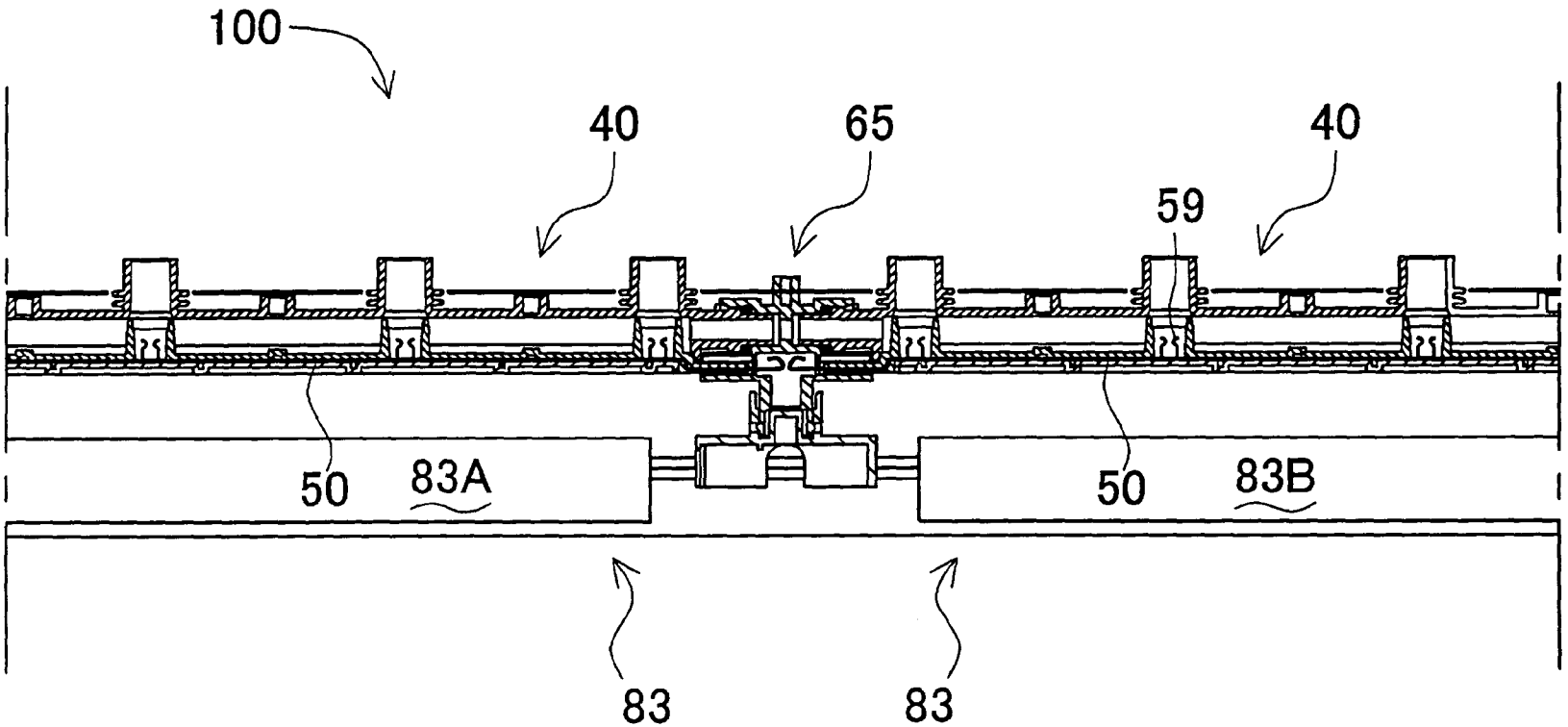
FIG. 9 shows a cross-sectional view illustrating the vicinity of a power supply joint in the middle of the ionization device.

FIG. 6 to FIG. 8 show cross-sectional views of illustrating the vicinity of ends of the ionization device 100. In these figures, FIG. 6 shows a cross-sectional view illustrating a side at which the end gas port 22 is provided, FIG. 7 shows a cross-sectional view illustrating a side at which an end gas port 22 and a middle gas port 21 are provided, and FIG. 8 shows a cross-sectional view illustrating a portion at which the casing members 40 are coupled by a carrier gas supply joint 64. Further, FIG. 9 shows a cross-sectional view illustrating a portion at which, the casing members 40 are coupled by a power supply joint 65.

(Internal Connection Port 42)

Each casing member 40 is provided with internal connection ports 42 at both end surfaces so as to connect other casing members 40 in the length direction. The internal connection port 42 is provided with the internal gas port 43 for carrier air utilizing air as the carrier gas and the high voltage port 44 for the high voltage route VP, as shown in FIG. 5 to FIG. 7, and connects the internal gas port 43 and the high voltage port 44 in a state physically separated. With this configuration, because the carrier gas route GP and the high voltage route VP are physically separated, the insulation between the carrier gas route GP and the high voltage route VP can be maintained without fail. The internal gas port 43 and the high voltage port 44 are coupled to a coupling gas port 61 and a coupling high voltage port 62 of the coupling member 60, respectively (see FIG. 16 that is later described). In particular, the internal gas port 43 and the coupling gas port 61 are coupled with a joint via an O-ring 87A. Using an O-ring facilitate to realize an air-tight coupling state, which prevents insulation and an air leakage from the coupling portion, as well as intervention thereof.

(Supporting Plate 55)

Figure 10A:
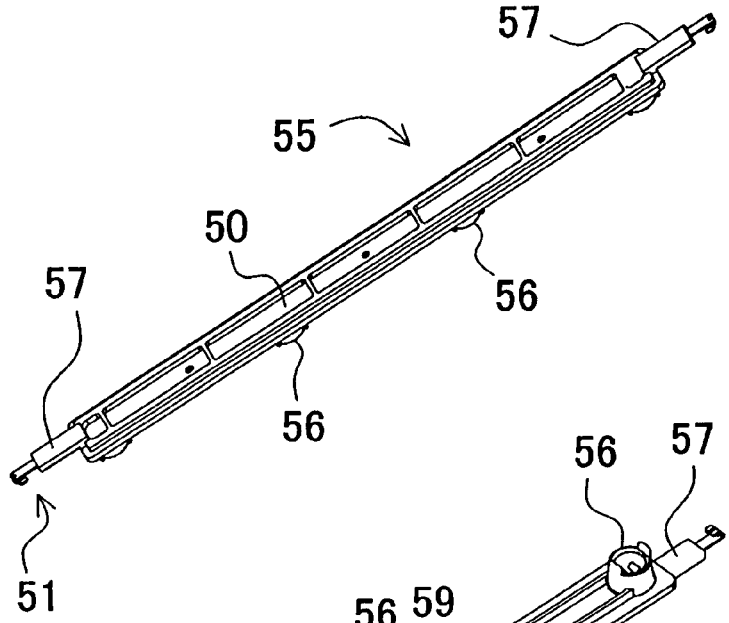
FIG. 10A shows a perspective view of a supporting plate viewed obliquely downward.
Figure 10B:
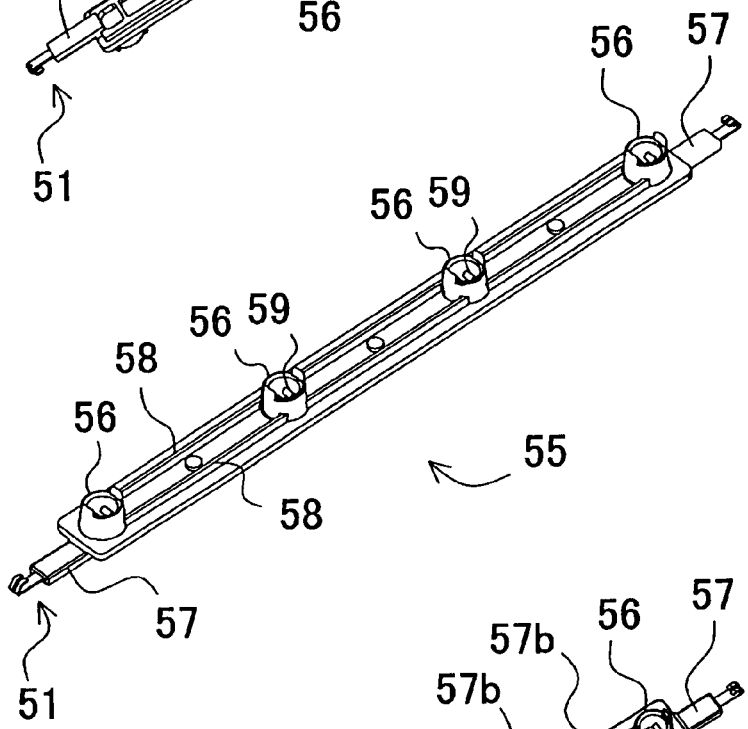
FIG. 10B shows a perspective view of the supporting plate viewed obliquely upward.
Figure 10C:
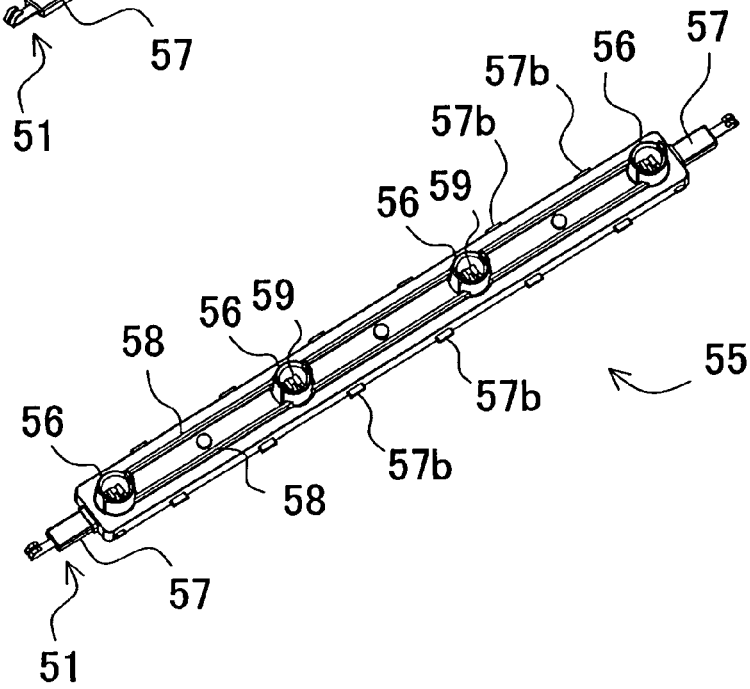
FIG. 10C shows a perspective view of the supporting plate, viewed obliquely upward, mounted to a lower casing and covered with a filling resin.

The supporting plate 55 supports the high voltage plate 50. FIG. 10 shows an appearance of the supporting plate 55. FIG. 10A shows a perspective view of the supporting plate 55 viewed obliquely downward, FIG. 10B shows a perspective view of the supporting plate 55 viewed obliquely upward, and FIG. 10C shows a perspective view of the supporting plate 55, viewed obliquely upward, mounted to the lower casing and covered with a filling resin JJ. As shown in these figures, the high voltage plate 50 is exposed at an upper surface of the supporting plate 55, and edge portions of side surfaces and a lower surface of the supporting plate 55 are covered by a covering resin (excluding a portion where a contact segment 59 is provided). Further, the supporting plate 55 is provided with a first sleeve 56 for setting the needle electrode 90 to be coaxial with a lower casing 45 of the casing member 40 into which the needle electrode 90 is to be inserted. In an example of FIG. 10, the supporting plate 55 is configured to be attachable with four needle electrodes 90. It is also possible to configure a casing member to be attachable with less than or more than four needle electrodes 90. It is also possible to configure a casing body using casing members with different numbers of electrodes. Further, the insertion portion 57 that covers around the high voltage plate 50 is formed at the edge of the supporting plate 55, and a connecting terminal 51 formed at the edge of the high voltage plate 50 further protrudes from the insertion portion 57.

The supporting plate 55 has such a structure in which, in holding the high voltage plate 50, the high voltage plate 50 is covered on a side of the air route, i.e. the lower portion, excluding a portion of the electrode assembly 92 where the needle electrode 90 is inserted, so that the high voltage plate 50 is not exposed to the air route. Specifically, it is sufficient to cover the high voltage plate 50 so as not to be exposed on the air route side, and the high voltage plate 50 may be exposed on the upper portion i.e. a side of the high voltage route VP. On the air route side of the high voltage plate 50, the contact segment 59 is provided only at a portion brought into contact with the needle electrode 90 and exposed to the air route side, the first sleeve 56 is formed so as to surround the exposed portion.

(Lower Casing 45)

Figure 11A:
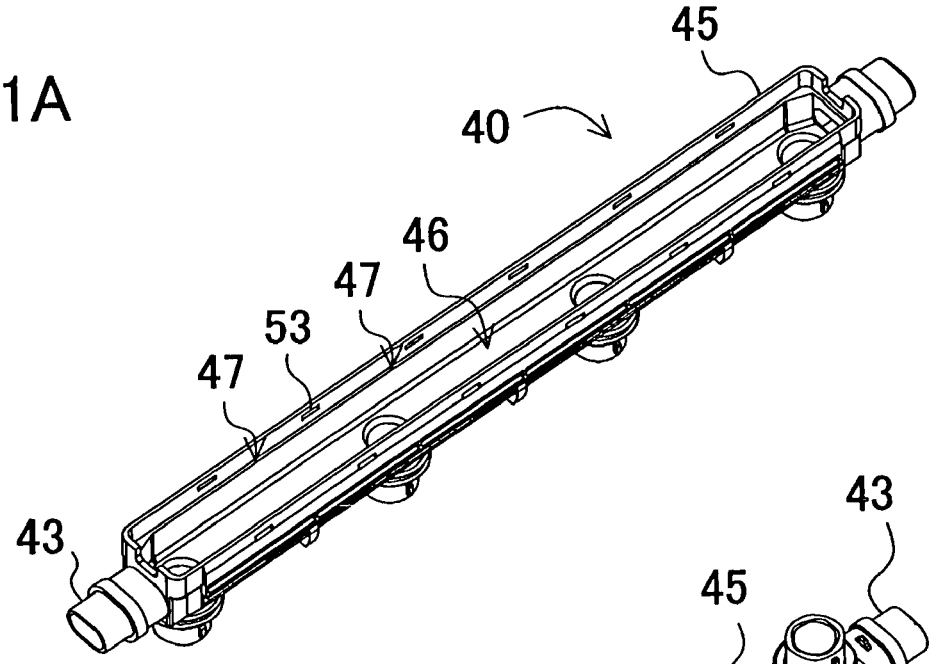
FIG. 11A shows a perspective view of the lower casing viewed obliquely downward.
Figure 11B:
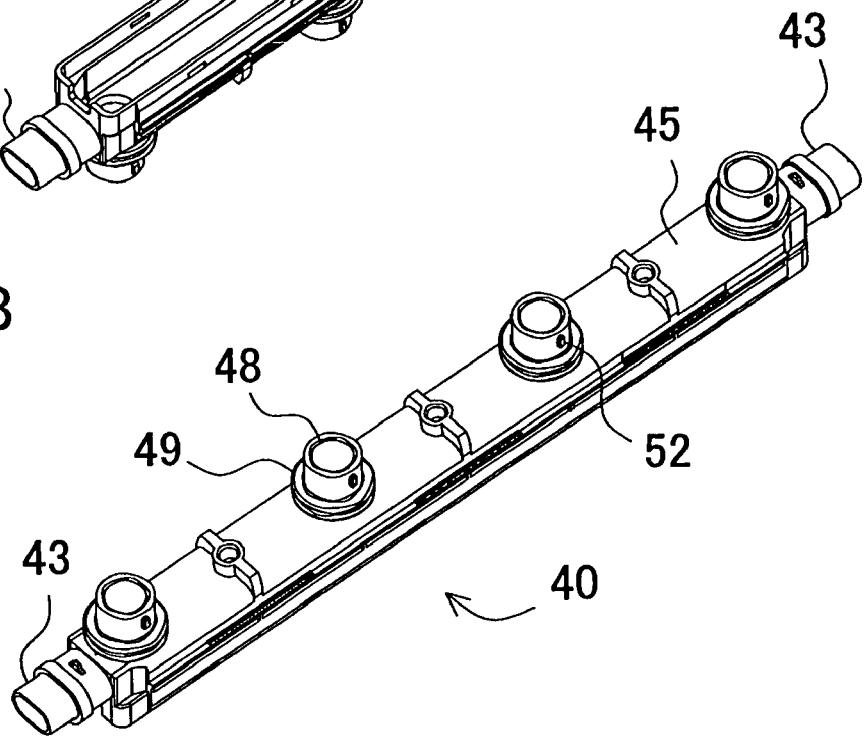
FIG. 11B shows a perspective view of the lower casing viewed obliquely upward.
Figure 12:
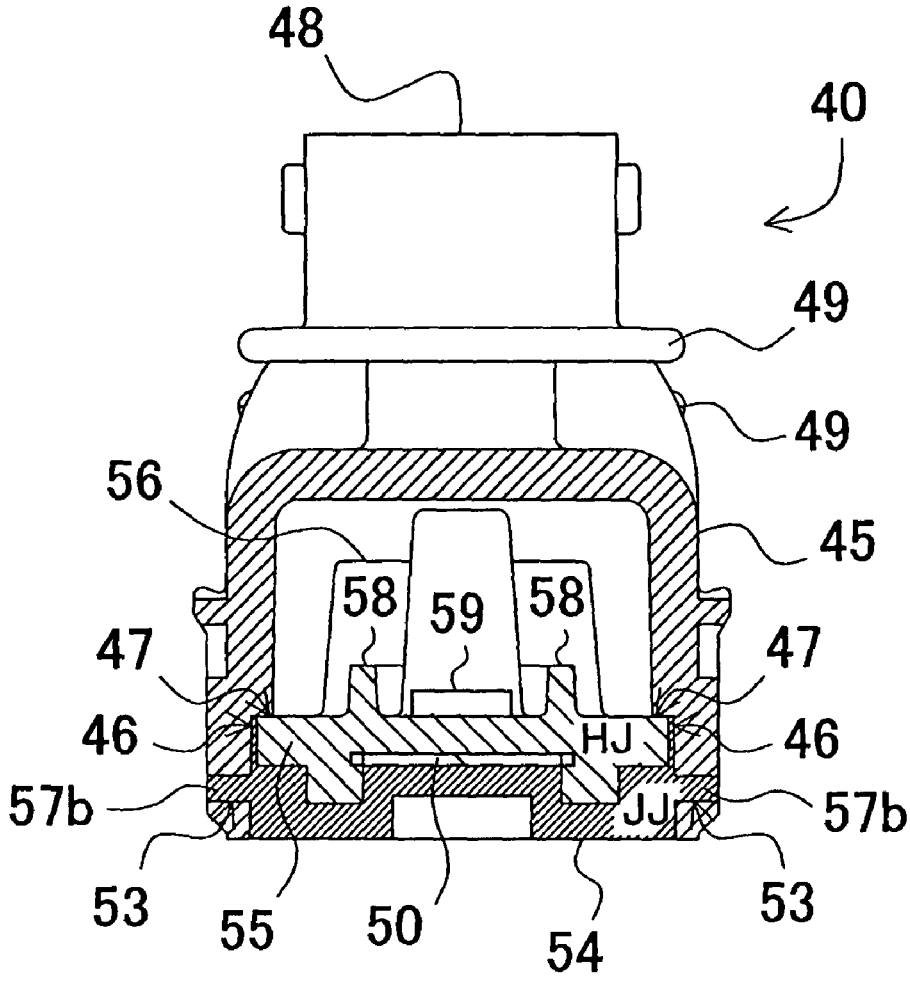
FIG. 12 shows a transverse sectional view of a casing member.

FIG. 11A and FIG. 11B show an appearance of the lower casing 45 that constitutes the casing member 40. FIG. 11A shows a perspective view of the lower casing 45 viewed obliquely downward, and FIG. 11B shows a perspective view of the lower casing 45 viewed obliquely upward. The lower casing 45 is formed into a rectangular box having two substantially parallely spaced side walls, two end walls that continue from the respective side walls, a bottom wall, and an opening on top. The supporting plate 55 is inserted on a side of a lower casing opening 46. The supporting plate 55 is provided with ribs at top and bottom, and formed into a size and shape that is insertable into the lower casing opening 46. FIG. 12 shows a cross-sectional view of the casing member 40 in which the supporting plate 55 is covered with a resin and set in the lower casing opening 46. In this example, the lower casing opening 46 is designed such that an inner diameter at the lower portion is made smaller than a width of the supporting plate 55, and a step portion 47 is provided at an edge of the opening so as to block the opening by supporting the supporting plate 55 with the step portion 47.

By blocking the lower casing opening 46 with the supporting plate 55, an enclosed space that constitutes the carrier gas route GP having a linear shape. With this configuration, as shown in such as FIG. 4 and FIG. 15 (cross-sectional view of the power supply joint 65), the carrier gas route GP constituting a part of a gas route is formed between a lower surface of the supporting plate 55 and the electrode assembly 92 (described later).

The lower casing 45 is provided with a relatively long second sleeve 48 having cylindrical shape that is coaxial with the first sleeve 56 provided for the supporting plate 55 and is relatively short. The second sleeve 48 extends downward from the bottom wall of the lower casing 45, and opens both ends. Specifically, the second sleeve 48 constitutes a penetrating hole that extends upward and downward, and it is preferable that the second sleeve 48 has a larger diameter than the first sleeve 56. Two peripheral flanges 49 for enlarging the creepage distance is formed at a base portion of the second sleeve 48 on an outer periphery of the second sleeve 48.

(High Voltage Plate 50)

The high voltage plate 50 is formed in a plate shape extended in the longitudinal direction as the casing member 40, and is formed by a material with excellent conductive property. By forming the high voltage plate 50 with such as, for example, stainless steel, it is possible for the high voltage plate 50 to serve as a reinforcement plate in the length direction of the ionization device while maintaining the conductivity, and to improve rigidity. The high voltage plate 50 is connected to a positive booster circuit 83A and a negative booster circuit 83B that constitute the electrical circuit unit 80 via the power supply joint 65. The high voltage plate 50 has a shape extended linearly from one end to the other end of the supporting plate 55. Further, one end of the high voltage plate 50 constitutes the connecting terminal 51 that accept high voltage energy from the electrical circuit unit 80, and the connecting terminal 51 is protruded at an end surface of the supporting plate 55 to electrically connect to the power supply joint 65.

(Connecting Terminal 51)

Figure 13:
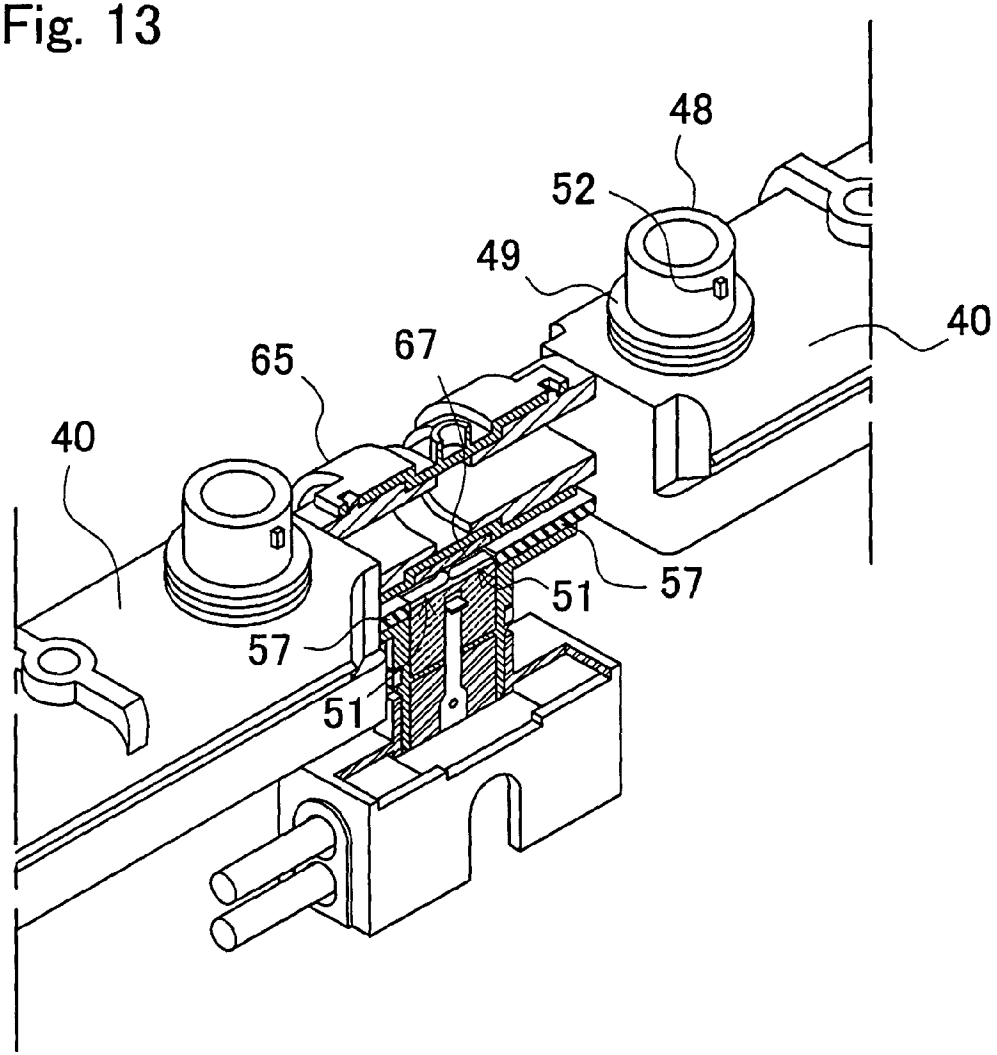
FIG. 13 shows a perspective view that is partially cross-sectioned, illustrating a joint portion where casing members are coupled with the power supply joint.
Figure 14:
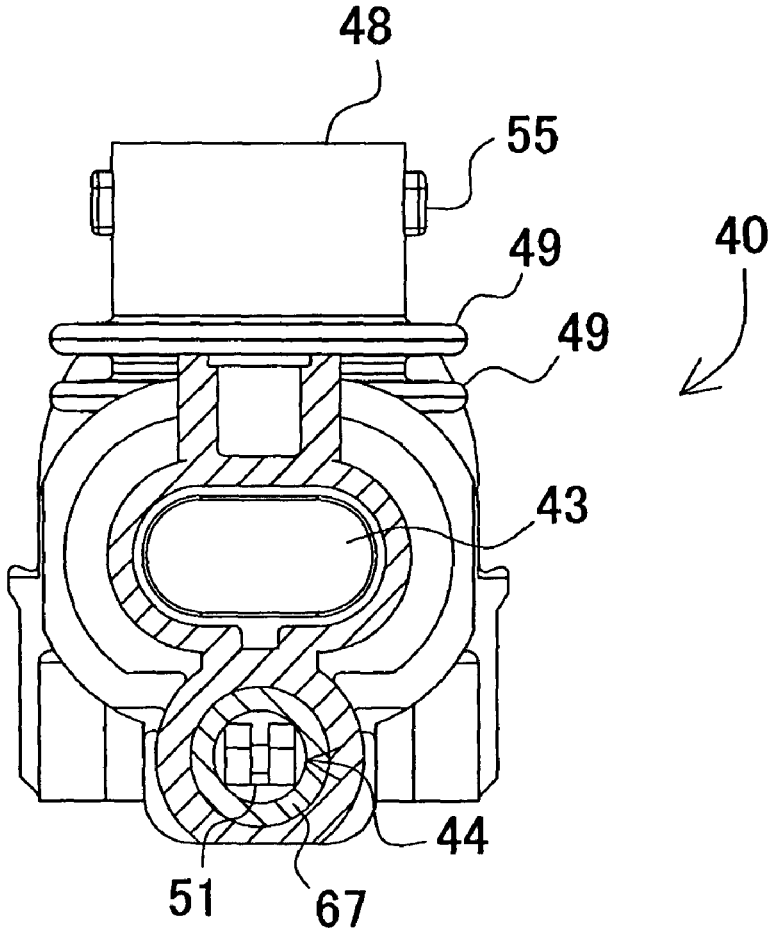
FIG. 14 shows a vertical cross-sectional view illustrating a standard joint.

The connecting terminal is further protruded from 51 the insertion portions 57 that protrude from the both ends of the casing member 40. FIG. 13 shows an enlarged view of a portion at which the casing members 40 are coupled with the power supply joint 65. As shown in the figure, the connecting terminal 51 forms a U-shaped piece by curved and field in a substantially U shape. Further, the U-shaped piece is branched into two, as shown in FIG. 14 (vertical cross-sectional view of a standard joint 63). With this configuration, according to a curved surface inside an the electrode connecting pipe 67 that is described later, the branched U-shaped piece is deformed elastically and facilitates the contact.

Figure 15:
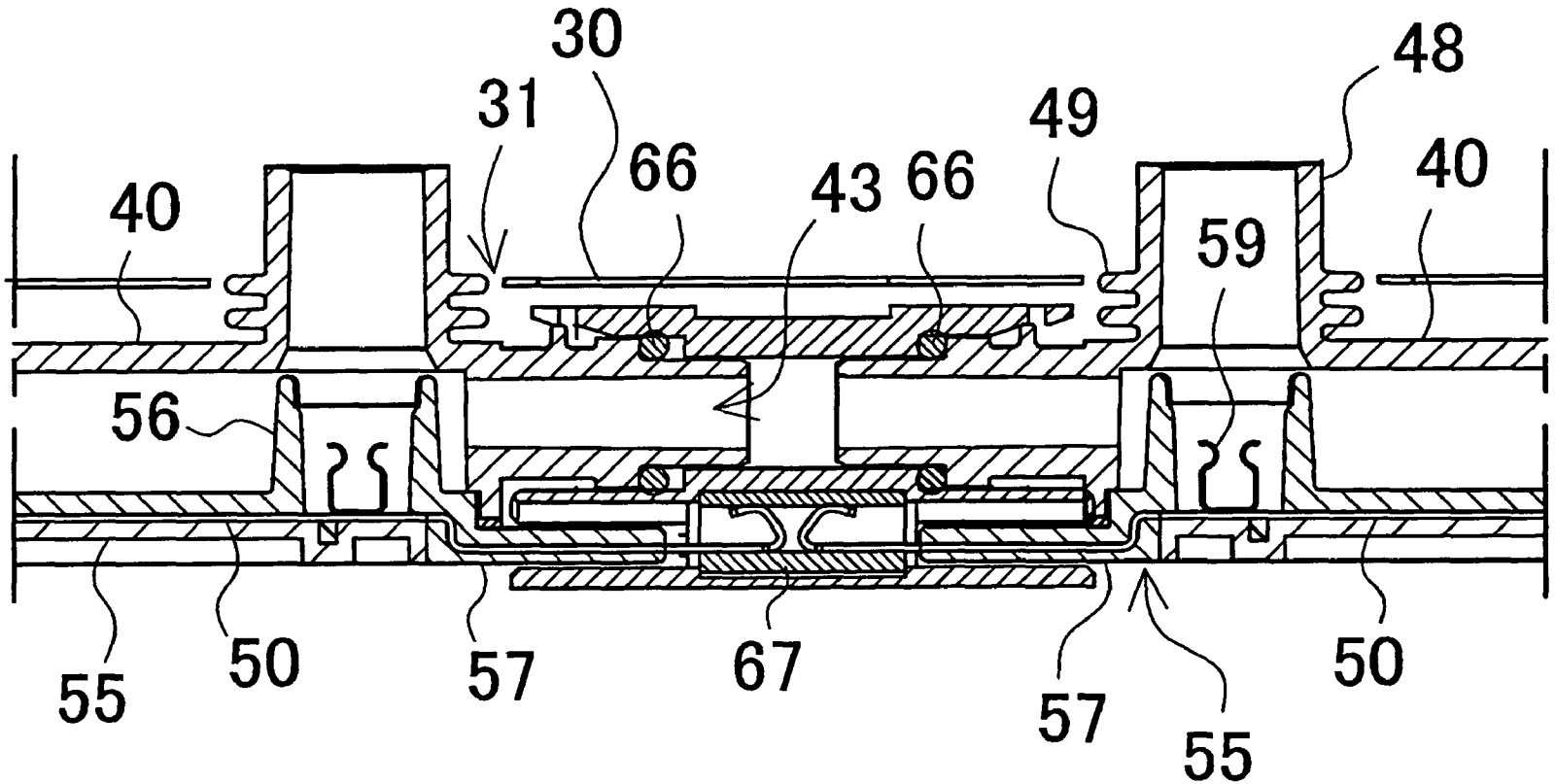
FIG. 15 shows a transverse sectional view illustrating the joint portion of the power supply joint.

The high voltage plate 50 is integrally interposed in the supporting plate 55 by insert molding. With this, the high voltage plate 50 is securely fixed to the supporting plate 55, and it is possible to eliminate a creepage route without exposing an unnecessary portion within the main body casing 10. The supporting plate 55 is constituted from a resin molding material and such into a frame shape with a bottom with top side open as shown in FIG. 10A, and insert molded so that the high voltage plate 50 is exposed at an upper surface of this frame shape. The opening of this frame shape is an elongated rectangular that substantially goes along with the shape of the high voltage plate 50. Further, an area of the opening of the frame shape is made smaller than an area of the high voltage plate 50, and accordingly, useless discharge is avoided by surrounding the high voltage plate 50 with the supporting plate 55 and covering the edge portion without fail. The high voltage plate 50 that is exposed at the upper surface is covered by a fixing plate 54 as described later. The high voltage plate 50 is folded in the vicinity of its end portion while the connecting terminal 51 at the end portion is being exposed, as shown in FIG. 6 and FIG. 15, and the insertion portion 57 is formed at the end portion of the supporting plate 55 by covering the folded portion from the folded portion to the tip end with the covering resin. In this manner, by forming the folded portion and covering around the folded portion with the covering resin, it is possible to increase juncture between the high voltage plate 50 and covering resin at this portion.

Further, as shown in FIG. 10B, a lower surface of the supporting plate 55 is also formed in a frame shape, and the first sleeve 56 is provided at the middle of the frame shape, the rib 58 is bridged over a portion where the first sleeve 56 is not provided to reinforce. At the lower surface of the supporting plate 55, the high voltage plate 50 is covered completely so that the high voltage plate 50 is not exposed except for the portion of the first sleeve 56, and thus formation of the creepage route is prevented. On the other hand, for the portion of the first sleeve 56, the high voltage plate 50 is exposed at a bottom surface of the cylindrical first sleeve 56 to form the contact segment 59 with the needle electrode 90.

(Contact Segment 59)

The high voltage plate 50 is provided with the contact segment 59 for electrically connecting with the needle electrode 90, at a portion of the supporting plate 55 corresponding to the first sleeve 56. The contact segment 59 is such that a pair of contact surfaces face each other as shown in FIG. 10B, and holds the end surface of the needle electrode 90 interposed therebetween. A tip of the contact segment 59 is made curved so as to decrease a gap between the contact surfaces, the needle electrode 90 is electrically holds therebetween to achieve an electrical connection without fail. The contact segment 59 is preferably the formed by the same material as high voltage plate 50, and, for example, a stainless steel plate is brought into contact with the contact segment 59 in a state of a square with one side open to fix to the high voltage plate 50. Alternatively, the contact segment can be formed by the high voltage plate.

(Two Step Filling of Resin)

Figure 32A:
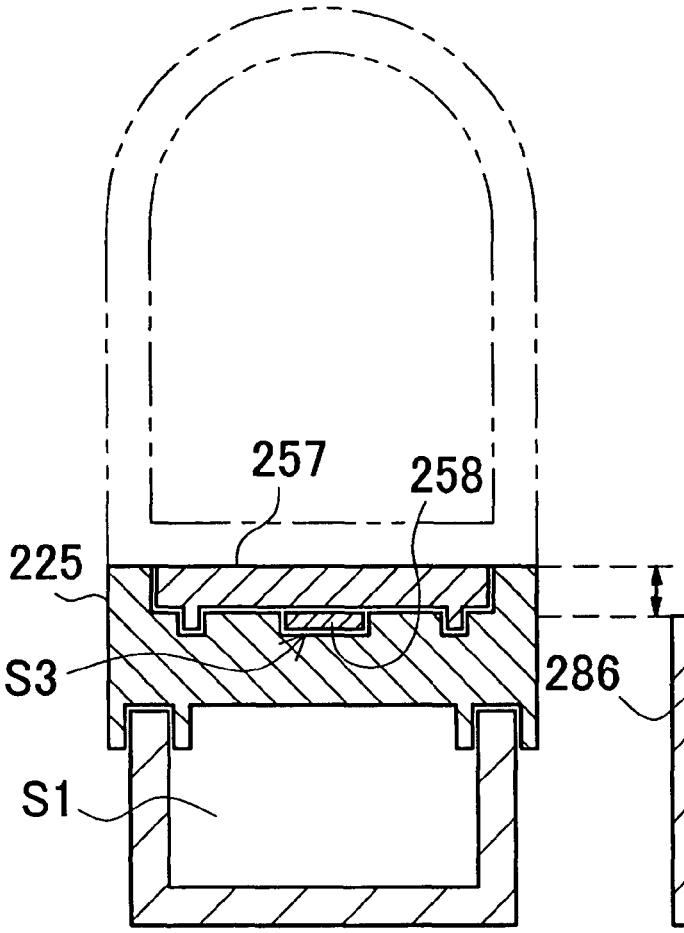
FIG. 32 shows a schematic cross-sectional view illustrating a configuration where the conventional high voltage plate is covered.

As apparent from the transverse sectional view of the casing member 40 shown in FIG. 12, the high voltage plate 50 is covered with a covering resin HJ and the filling resin JJ. Conventionally, it has been widely employed to cover the edge portion of the high voltage plate with such as resin so as to prevent discharge due to an exposed edge of the high voltage plate. FIG. 32 shows a configuration in which a conventional high voltage plate is covered. In an example shown in FIG. 32A, in order to separate a main air channel S1 and a high voltage route S3, ultrasonic welding is performed at a portion indicated by A in FIG. 32A in a state a high voltage plate 258 is held between a fixing plate 257 and a supporting plate 225, and then, the supporting plate 225 and a box member are coupled at a portion indicated by B by such as ultrasonic welding. In this configuration, it is necessary to assemble four members, and there are problems that steps such as the ultrasonic welding takes time and that assembling is costly.

Figure 32B:
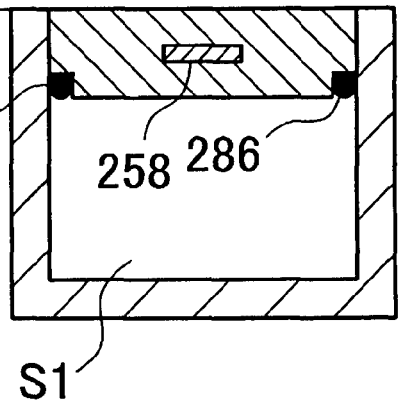

On the other hand, in a configuration shown in FIG. 32B, a main air channel S1 and a high voltage route S3 are separated by previously insert molding the high voltage plate 258 to the supporting plate 55, and the supporting plate 55 and by connecting the casing member 40 by a O-ring 286 in an air tight manner. With this configuration, the ultrasonic welding is unnecessary, and cost for ultrasonic welding the rib and the groove. However, according to this method, because the main air channel S1 is sealed air-tight using the O-ring 286, there is a problem that the channel becomes narrower by an area of the O-ring 286.

On the other hand, in this embodiment, as shown in FIG. 12, the upper surface of the high voltage plate 50 (lower surface in FIG. 12) is first exposed, and then the supporting plate 55 covered with the covering resin HJ at the edge portion of the side surface and the lower surface (excluding a portion where the contact segment 59 is provided). The molding of the resin for the supporting plate 55 is performed by the insert molding. It is also possible to use such as transfer molding and injection molding.

Next, the supporting plate 55 is inserted into the lower casing 45 shown in FIG. 11. The lower casing 45 has a cross-section that is substantially a square with one side open, and opens. The lower casing opening 46 constitutes the carrier gas route GP within the casing member 40. The supporting plate 55 is inserted into the lower casing opening 46, the supporting plate 55 is supported by the step portion 47, and the lower casing opening 46 is blocked, thereby forming an inner space as the carrier gas route GP. At this time, the supporting plate 55 is inserted into the lower casing opening 46 in a state in which the exposed surface of the high voltage plate 50 faces upward. In this state, the filling resin JJ is further filled in the lower casing opening 46 to form a fixing plate 54, and the supporting plate 55 including the exposed portion of the high voltage plate 50 is completely embedded in the lower casing 45 with the fixing plate 54. By using the same material for both the covering resin HJ and the filling resin JJ, it is possible to achieve firm fixation at a boundary even with two-stepped resin molding, and the casing member 40 can be formed in which the supporting plate 55 and the lower casing 45 are formed integrally.

On the side surface of the lower casing 45, as shown in FIG. 12, a slit 53 communicating outside is formed in a state in which the supporting plate 55 is set to the lower casing opening 46. With this configuration, in the second step of the resin molding, the filling resin JJ solidifies while being filled in the slit 53 to form a protrusion 57*b,* and the fixing plate 54 is securely fixed at the lower casing opening 46.

According to the above described method, it is possible to cover the high voltage plate 50 completely and to effectively prevent discharge due to the presence of the air, and a creeping discharge route will not be formed because embedded in the resin. In addition, it is possible to fix the high voltage plate 50 to the lower casing 45 at the same time, and accordingly, a welding step such as the ultrasonic welding is not necessary and workability in the assembly may be improved. Moreover, it is not necessary to provide a stage for the ultrasonic welding, thereby allowing further miniaturization. Further, the method is dust free due to the ultrasonic welding, and the air-tightness using such as O-ring is not necessary. In addition, in the second step of the resin molding, as shown in FIG. 12, the supporting plate 55 is held at the step portion 47 of the lower casing opening 46 and blocks, the filling resin JJ will not overflow into the carrier gas route GP, and a pressure at the resin molding will not narrow the carrier gas route GP.

It should be noted that the covering by the resin as described above is performed for the high voltage plate 50 excluding the edge of the high voltage plate 50. Specifically, for a finished form of the casing member 40, the connecting terminal 51 of the high voltage plate 50 for electrical connection is protruded as shown in FIG. 5.

(Coupling Member 60)

The coupling members 60 are used to couple the casing member 40. As shown in FIG. 6 to FIG. 9, FIG. 13, and FIG. 16, the coupling member 60 is provided with the coupling gas port 61 for coupling a gas port 43 of the casing member 40 and the coupling high voltage port 62 for coupling the high voltage port 44. The coupling member 60 is provided between the two casing members 40, the casing members 40 are inserted from the respective sides of the coupling member 60, and the gas port 43 and the high voltage port 44 of the two the casing members 40 communicate. In this embodiment, as the coupling member 60, a join that couples the casing member 40 by inserting and pulling along the longitudinal direction of the main body casing 10. With this, it is possible to adjust a dimension error of the casing member 40 along the longitudinal direction by an amount of insertion to the joint.

Figure 33:
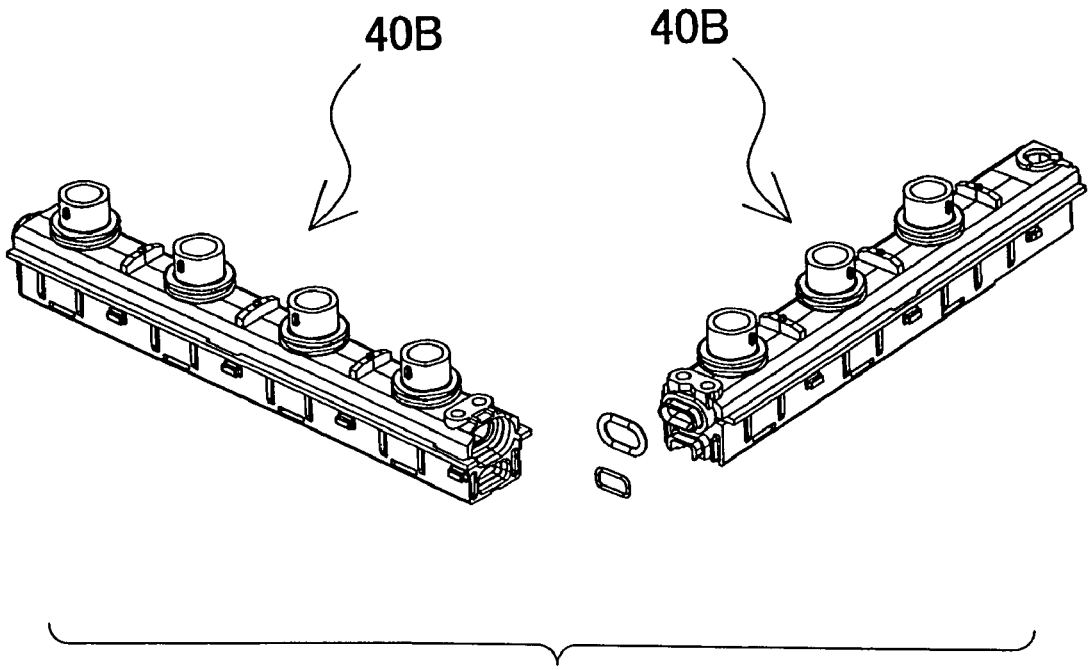
FIG. 33 shows a perspective view illustrating a coupling portion at which casing members are coupled in the conventional electricity remover.

In the conventional ionization device, as shown in FIG. 33, because the casing members 40B are directly coupled, a total length of the casing body in which the casing members 40B are coupled is fixed. As a result, there has been a risk that the casing body becomes battered or cannot be housed in the main body casing due to a dimension error between the casing body and the main body casing that houses the casing body. In particular, in a structure in which a large number of casing members 40B are coupled, the dimension error can be accumulated and a mismatch in sizes can easily occur. In contrast, in this embodiment, the presence of the coupling member 60 allows such a dimension error by adjusting the amount of insertion of the casing members 40 into the coupling member 60.

Figure 16:
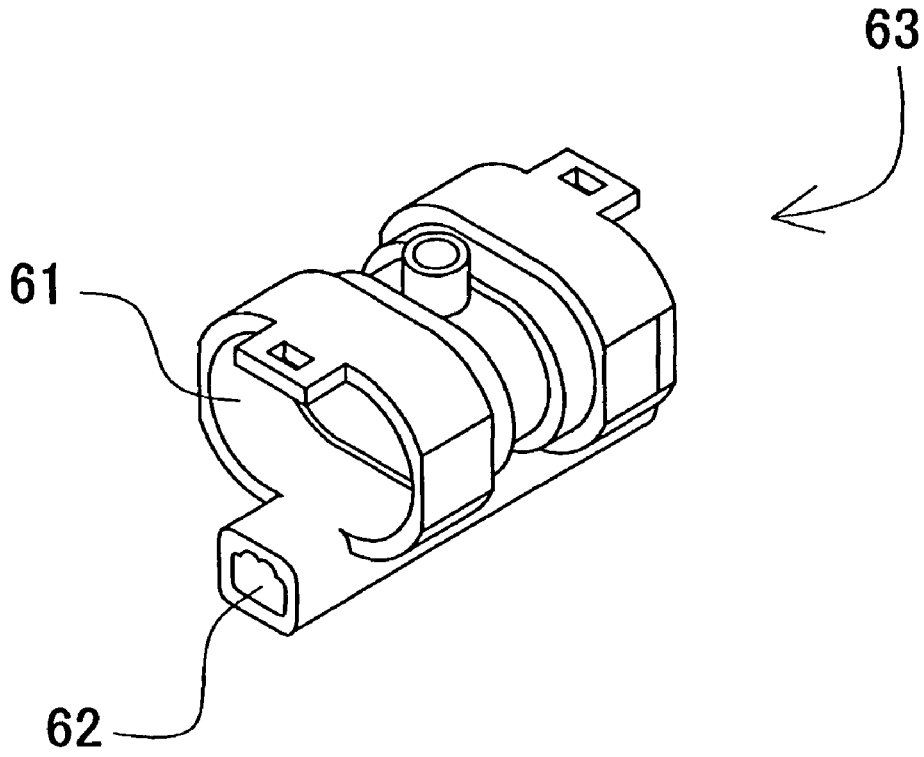
FIG. 16 shows a perspective view illustrating the standard joint.

The coupling high voltage port 62 and the coupling gas port 61 are formed, as shown in FIG. 13 and FIG. 16, in the stated order toward a direction in which the ions are emitted from the needle electrode. With such an arrangement, it is possible to coincide positions of the coupling high voltage port 62 and the coupling gas port 61 with positions of the high voltage route VP and the carrier gas route GP of the casing member 40, and to pass each route through the casing body 41 substantially linearly. Moreover, it is preferable that the coupling high voltage port 62 and the coupling gas port 61 are formed into a single piece. With this configuration, it is possible to form the ports at low cost, and to increase the strength of the coupling members, thereby contributing to an improvement of the rigidity of the ionization device.

(Joint)

Figure 17:
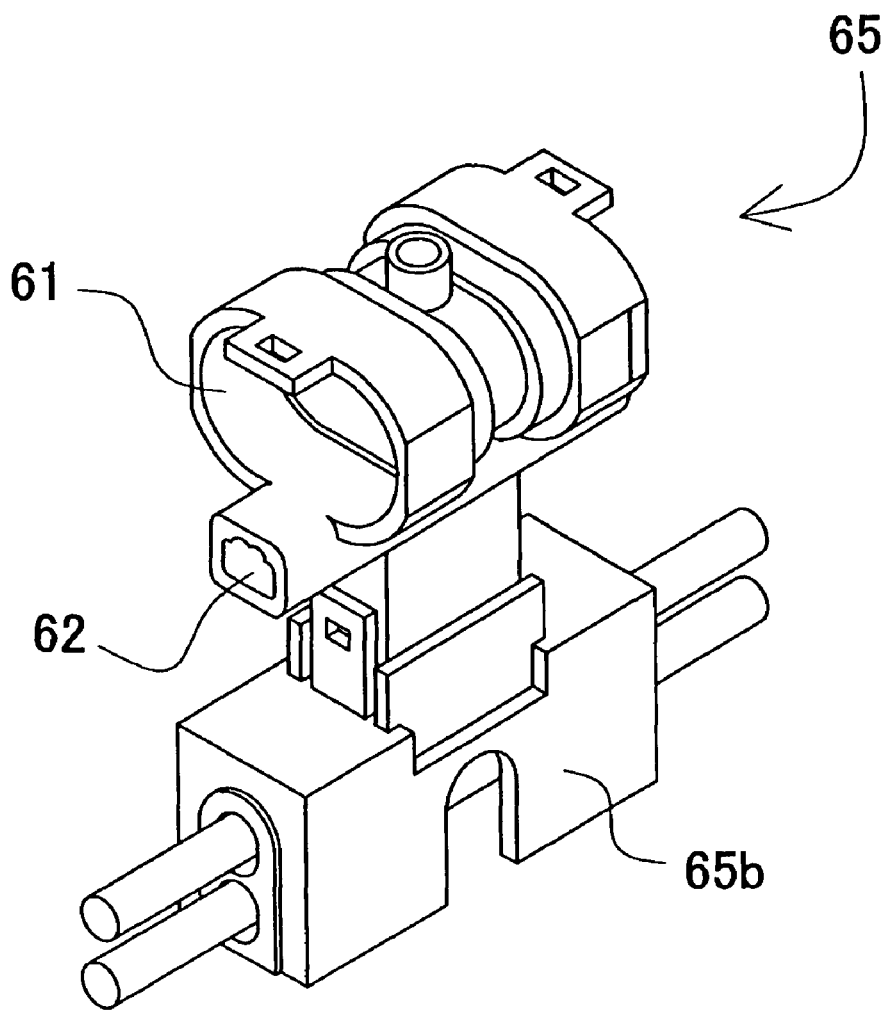
FIG. 17 shows a perspective view illustrating the power supply joint.
Figure 18:
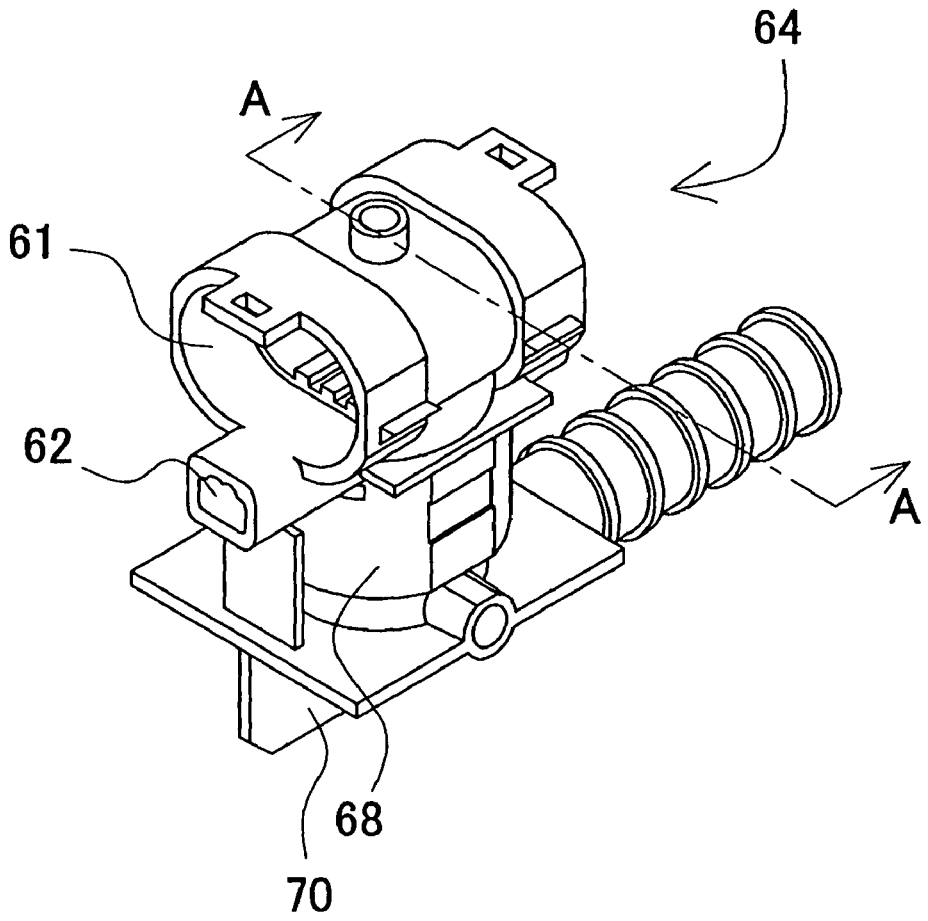
FIG. 18 shows a perspective view illustrating a carrier gas supply joint.

In this embodiment, three types of joints are used to constitute the coupling member 60: the carrier gas supply joint 64 for connecting a middle carrier gas piping 71, and the power supply joint 65 for connecting high voltage generated by the electrical circuit unit 80 to the high voltage plate 50 of the casing member 40, in addition to the standard joint 63. FIG. 16 shows the standard joint 63, FIG. 17 shows the power supply joint 65, and FIG. 18 shows the carrier gas supply joint 64. Further, FIG. 14 shows the standard joint 63, and FIG. 15 shows a cross-sectional view of the joint portion of the power supply joint 65.

Each joint is, as shown in FIG. 6 to FIG. 9 and FIG. 16, provided with the coupling gas port 61 for passing carrier gas, and the coupling high voltage port 62 for coupling the high voltage plates 50 separately. In an example shown in FIG. 16, the coupling gas port 61 that is hollow opens downward (upward in FIG. 16) and cylindrical and the coupling high voltage port 62 that is smaller than the coupling gas port 61 opens upward. These are the penetrating holes and the casing member 40 can be inserted through either of the openings.

The coupling gas port 61 has a curved inner surface by chamfering the inner surface to carry the carrier gas to each needle electrode 90 so that the gas flows smoothly. In this example, an area of the opening of the coupling gas port 61 is made larger than an area of the coupling high voltage port 62 so that a sufficient amount of the carrier gas can be carried. In connecting the coupling gas ports 61, while a flexible tube 135 such as a rubber pipe is conventionally used as shown in FIG. 28 and FIG. 29, in this embodiment, using a joint having high rigidity contributes to an improvement of rigidity at the coupling portion. Further, the internal gas port 43 of the casing member 40 is coupled air tightly to the coupling high voltage port 62 so that no gas leakage may occur at the joint portion. In an example shown in FIG. 15, an O-ring 66 is provided at an outer periphery of the internal gas port 43 to seal.

(Electrode Connecting Pipe 67)

The coupling high voltage port 62 is formed, such that its opening is substantially rectangular into a size and a shape, in which the insertion portion 57 of the casing member 40 can be inserted. Further, the electrode connecting pipe 67 that is hollow and cylindrical having a smaller diameter than an end of the rectangular opening is provided inside the coupling high voltage port 62, as shown in FIG. 13 to FIG. 15. The electrode connecting pipe 67 is formed by a material having excellent conductive property, in which a U-shaped piece (described later) that is the connecting terminal 51 formed at the edge of the high voltage plate 50 is brought into contact with on a cylindrical inner surface for electrical connection. Further, the joint is embedded such that the electrode connecting pipe 67 is formed by such as the insert molding to match its opening portion with inside of the coupling high voltage port 62. It is sufficient if the electrode connecting pipe 67 has a hollow cylindrical opening, and it is not necessary to have a cylindrical inner surface or appearance. For example, the electrode connecting pipe 67 can be rectangular. For example, it is possible to facilitate installation of the electrode connecting pipe 67 by making the external shape into a block shape, and therefore it is possible to use the electrode connecting pipe 67 having a penetrating hole in a block-shaped metal. On the other hand, by making the inner surface of the electrode connecting pipe 67 cylindrical, the edge can be reduced and the risk of discharge can be further reduced.

The connecting terminal 51 that protrudes from the edge of the casing member 40 is inserted into the electrode connecting pipe 67. As described above, the connecting terminal 51 is folded substantially in a U shape to form the U-shaped piece. As shown in FIG. 13 and FIG. 15, the connecting terminal 51 is brought into contact with the inner surface of the electrode connecting pipe 67 to be electrically connected at two portions of the bottom surface and a folding portion of the U-shaped piece the connecting terminal 51. In this manner, it is possible to reduce the edge portion and prevent useless discharge by having the connecting terminals 51 face in a state the connecting terminals 51 are folded in a R shape, instead of facing at edge surfaces. Also in this example, by intentionally providing a space between the rear surfaces of the U-shaped pieces that are facing each other, a loose connection at this portion is avoided, and conduction to the inner surface of the electrode connecting pipe 67 that achieves more secure contact is utilized. In particular, as shown in FIG. 14, because the U-shaped piece of the connecting terminal 51 is branched into two branches, according to the curved surface inside an the electrode connecting pipe 67, the branched U-shaped piece is deformed elastically to be brought into contact with the curved surface without fail thereby eliminating any loose connection.

(Carrier Gas Supply Joint 64)

As described above, the standard joint 63 connects the adjacent casing members 40, and the carrier gas route GP and the high voltage route VP. On the other hand, the carrier gas supply joint 64 connects, as shown in FIG. 3 and FIG. 8, the casing members 40 in the middle of the main body casing 10, and supplies the carrier gas from this point to the casing members 40 that are connected to the both ends. With this configuration, the carrier gas is supplied from the both ends and the middle of the casing body 41 via the carrier gas supply joint 64.

In a case of the conventional bar-type ionization device, when ionization device is extended long the longitudinal direction, the carrier gas supplied from the both ends to the needle electrode becomes difficult to be carried, and there are problems that sufficient amount of ions do not fly due to a decreased gas pressure and that an effect of the removal of electricity becomes uneven because a distance that the ion flies vary depending on a position of the needle electrode. In contrast, in this embodiment, the carrier gas can be directly supplied to the casing member 40 in the vicinity of a center portion via the joint. Accordingly, even when the bar-type ionization device is extended in the longitudinal direction, the problems of insufficient carrier gas and unevenness can be eliminated. In particular, by providing the joint with a carrier gas supply mechanism without providing a member specifically for supplying the carrier gas, it is possible to supply the carrier gas to a desired position only by modifying the joint, thereby contributing to simplification of the configuration and an improvement of assembly work. In the example shown in FIG. 3, the carrier gas supply joint 64 is used at a position 1.5 meters away from the end surface of the ionization device 100 whose total length is 3 meters that houses the casing body 41 in which ten casing members 40 are connected, specifically, a position of the joint that connects fifth and sixth casing members 40 from the end portion. It should be noted that the casing members 40 positioned at the middle indicates the casing members 40 other than the casing member 40 positioned at the end portion out of the plurality of the casing members 40 that constitute the casing body 41.

Figure 19:
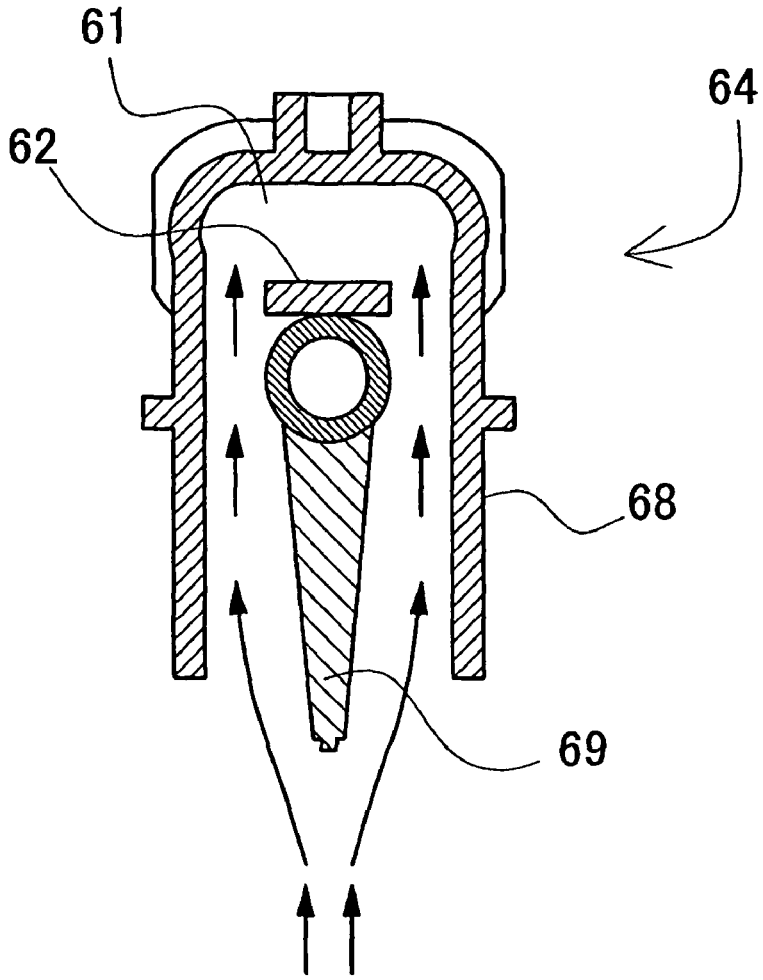
FIG. 19 shows a cross-sectional view the carrier gas supply joint taken at line A-A in FIG. 18.

FIG. 19 shows a cross-sectional view of the carrier gas supply joint 64 taken along line A-A in FIG. 18. As shown in the perspective view in FIG. 18 and a cross-sectional view in FIG. 19, the carrier gas supply joint 64 forms the carrier gas route GP and the high voltage route VP so as to be isolated from each other, and opens a carrier gas supply outlet 68 downward in the figure. As shown in the cross-sectional view in FIG. 19, the carrier gas supply outlet 68 communicates to the carrier gas route GP. At this time, in order that a carrier gas flow may not be disturbed by the high voltage route VP positioned between the carrier gas supply outlet 68 and the carrier gas route GP, the carrier gas guiding piece 69 is extended downward from the lower surface of the high voltage route VP in the carrier gas supply outlet 68. The carrier gas guiding piece 69 protrudes from the carrier gas supply outlet 68, and formed so as to be tapered toward a tip end thereof. With this configuration, the carrier gas flow supplied upward as in the cross-sectional view of FIG. 19 is divided into two by the tapered carrier gas guiding piece 69 and then introduced into the carrier gas route GP. With this configuration, the high voltage route VP is prevented from being a blockage thereby eliminating generation of a turbulent flow. Further, the carrier gas is smoothly introduced into the carrier gas route GP by reducing a pressure loss and, and discharged from around each needle electrode 90 communicating to the carrier gas route GP.

Figure 20:
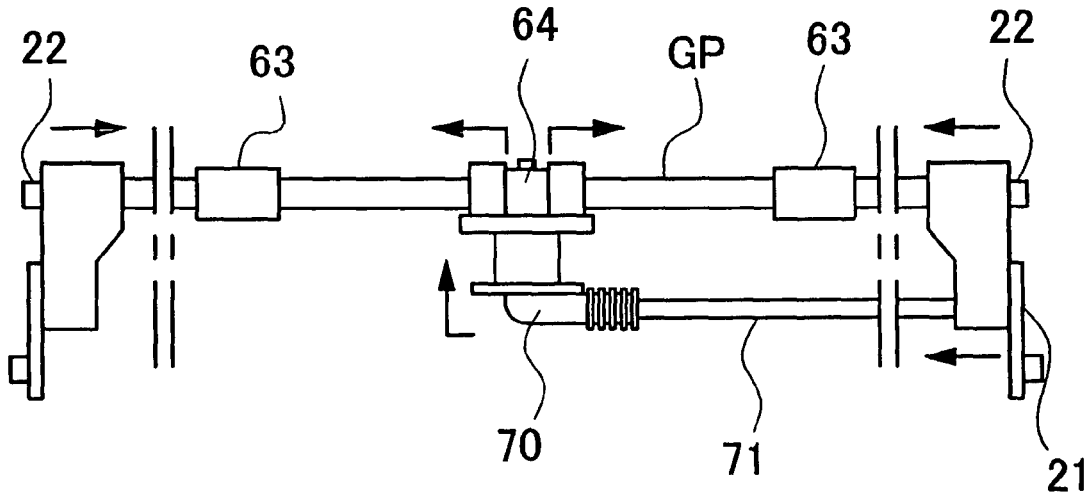
FIG. 20 shows a schematic diagram illustrating a piping for carrier gas and a route through which the carrier gas is carried.

The carrier gas supply outlet 68 is connected with a carrier gas valve 70 as a carrier gas supply connecting member to connect the middle carrier gas piping 71. The carrier gas valve 70 is inserted into the coupling gas port 61, as shown in FIG. 3, and inserted into the carrier gas route GP via the coupling gas port 61 by connecting to the middle carrier gas piping 71. The middle carrier gas piping 71 is positioned in the second space SP2 in the main body casing 10, and connected to the middle gas port 21 provided for the side cover 20 as shown in FIG. 7. FIG. 20 shows piping for carrier gas and a route through which carrier gas is carried. As shown in the drawing, One side cover 20 is provided with the end gas port 22, and the other side cover 20 is provided with the middle gas port 21, in addition to the end gas port 22. The carrier gas is carried via a cable from the air supply unit that is externally connected. A joint between the cable and the coupling port, i.e. between the end gas port 22 and the middle gas port 21 is coupled in a air tight manner using such as an O-ring. The carrier gas such as air is supplied from outside via the end gas port 22 and the middle gas port 21, and the carrier gas is introduced into the carrier gas route GP from the both ends and the middle of the ionization device. By this, the carrier gas is supplied stably to the middle casing members 40.

Further, a pressure of the carrier gas can be adjusted by the end gas port 22 and the middle gas port 21. For example, the pressure of the carrier gas supplied from the middle gas port 21 can be set slightly higher, considering that the piping route long and the pressure loss can be caused. Alternatively, it is possible to increase the flow rate by changing a diameter of the pipe.

As the middle carrier gas piping 71, a hard resin pipe can be utilized. It is also possible to contribute to an improvement of rigidity in the length direction by piping the middle carrier gas piping 71 along the longitudinal direction of the main body casing 10 to a portion in vicinity of the center. Furthermore, the reinforcement member 72 protect around the middle carrier gas piping 71, as shown in FIG. 2. The reinforcement member 72 has a square cross-section with one side open, and the middle carrier gas piping 71 is inserted into an opening portion of the square with one side open, and is made of hard material formed integrally by an extruded material such as resin along the length direction, thereby contributing a further improvement of rigidity of the main body casing 10. In the example shown in FIG. 2, the reinforcement member 72 is extended not only from a right end surface in the drawing of the main body casing 10 to a central portion where the middle carrier gas piping 71 is provided, but further to a portion close to a booster unit 83. In this manner, by inserting the reinforcement member 72 into a dead space of the main body casing 10, it is possible to improve rigidity.

(Power Supply Joint 65)

The power supply joint 65 connects the casing members 40 in the middle of the main body casing 10 as shown in FIG. 9 and FIG. 17, and saves as a voltage input unit for supplying high voltage generated by the electrical circuit unit 80 to the high voltage plate 50. Accordingly, the power supply joint 65 is provided with a power supply connecting member 65*b* for connecting an output terminal of the electrical circuit unit 80 and the high voltage plate included in the casing member via the coupling high voltage port. With this configuration, any additional wiring or member for supplying the high voltage generated by the electrical circuit unit 80 to the high voltage plate 50 of the casing member 40 is not required, and a single join achieves the coupling of the casing members 40 and the supply of the high voltage, thereby simplifying the configuration and promoting laborsaving of assembly steps.

(Electrical Circuit Unit 80)

The electrical circuit unit 80 is a circuit for generating high voltage to be applied to the needle electrode 90. In this specification, the high voltage refers to voltage having a potential difference of ±2 kV to 7 kV. When the potential difference is too high, an insulation breakdown may occur in the electricity remover, or discharge to the work may occur. On the other hand, when the potential difference is too low, the removal of electricity may not be performed. Accordingly, the potential difference is set within an appropriate range. The electrical circuit unit 80 is provided with a power unit 81, a control unit 82, and the booster unit 83. The power unit 81 is provided with a power supply circuit that is connected to an external power source and receives the power. The control unit 82 is provided with a control circuit that is driven by the power received by the power unit 81 and controls an operation of each needle electrode 90. The booster unit 83 is provided with a booster circuit that boosts the voltage received by the power supply circuit to generate the high voltage. In the example of FIG. 2, the booster unit 83 is provided with a positive booster circuit 83A for generating positive high voltage and a negative booster circuit 83B for generating negative high voltage. Further, the power supply joint 65 is disposed between the positive booster circuit 83A and the negative booster circuit 83B. With this configuration, as shown in FIG. 17, the positive and negative high voltages are switchably supplied from the both sides of the power supply joint 65, to the high voltage plate 50 of the casing member 40. Accordingly, the power supply joint 65 may incorporate an electronic relay that is switchable between the positive and negative high voltages.

These substrates are configured in respective units as shown in FIG. 2. In this manner, by dividing functions and purposes into groups and assigned to a plurality substrates, each substrate can be miniaturized and it is possible to facilitate an arrangement with reduced. In the example of FIG. 2, the power unit 81, the control unit 82, and the booster unit 83 are provided in a unit form in the second space SP2 of the main body casing 10, and can be efficiently housed within a limited space in the main body casing 10. The electrical circuit unit 80 including the power unit 81 is preferably positioned at the end portion in the main body casing 10 along the longitudinal direction. With this configuration, it is possible to improve a moment slightly, to arrange in a balanced manner, and to eliminate a dead space. Further, the electrical circuit unit 80 is positioned at one end portion, and the middle carrier gas piping 71 is positioned at the end portion, i.e. the side cover 20 provided with the middle gas port 21, thereby efficiently utilizing the space inside the main body casing 10. In addition, by extending the reinforcement member 72 from a side of the side cover 20 provided with the middle gas port 21, and by filling the dead space with the reinforcement member 72, where the electrical circuit unit 80 is not provided, it is possible to improve rigidity as much as possible.

By disposing electrical circuit members that are made into a unit form in the space above the supporting plate 55 within the main body casing 10, it is possible to efficiently assemble necessary members within the main body casing 10. Further, as a countermeasure for an electrical leakage, it is possible to fill a filling material such as silicone resin after the control unit 82 incorporating a high voltage power supply circuit is constructed.

According to the above embodiment of the several joints 63, 64 and 65, one the carrier gas route GP of one casing member connected to one end of the joint 63, 64 or 65 is connected to anther carrier gas route GP of another casing member connected to the another end of the same joint. However, when the carrier gas supply joint 64 is disposed at the intermediate portion the main body casing 10, it is also preferred that the carrier gas supply joint 64 may have a block portion between the carrier gas routes GP of the both connected casing members. In more detail, when the gas is supply to the main body casing comprising several connected casing members and joint from the end gas port 22 disposed at the right side of the device 100, the the carrier gas supply joint 64 disposed at the intermediate portion the main body casing 10 may provide the gas to the casing members disposed at the left side of the device 100. At this case, the carrier gas supply joint 64 may have a block portion between the carrier gas routes GP of the both connected casing members to maintain the same gas pressure to the right and left sides of the device.

(Needle Electrode 90)

FIG. 21 shows a cross-sectional view of a portion where the needle electrode 90 is provided in the ionization device. The needle electrode 90 integrated with the protecting member 91 for protecting the needle electrode 90, constitutes the electrode assembly 92. The electrode assembly 92 is detachably held by the second sleeve 48 of the casing member 40 and the first sleeve 56 of the supporting plate 55. Then, the electrode assembly 92 attached to the casing member 40 trails downward from the casing member 40 such that the lower end portion of the electrode assembly 92 is exposed from a cover portion 30 as a counter electrode plate.

(Electrode Assembly 92)

The needle electrode 90 of the electrode assembly 92 is made of such as tungsten, for example, and the needle electrode 90 is covered by the protecting member 91 at a tip end portion and a rear end portion, that is a portion of a main body excluding the upper end portion. The protecting member 91 includes a tubular portion with smaller inner diameter 93 that extends along the needle electrode 90, a circular portion 94 extending radially from a lower end of the tubular portion with smaller inner diameter 93, that is, a tip end portion of the needle electrode 90, and a tubular portion with larger outer diameter 95 that extends upward from an outer periphery of the circular portion 94. The tubular portion with larger outer diameter 95 extends upward from the circular portion 94, and extends along an outer periphery of the second sleeve 48 to a base end portion of the second sleeve 48, and a flange 96 is formed along an upper end so as to increase the creepage distance.

By mounting the electrode assembly 92 to the casing member 40, each needle electrode 90 is positioned, and a cylindrical branch air channel 97 is formed for each needle electrode 90 that continues to the carrier gas route GP of the casing member 40 and extends downward perpendicularly intersecting with the carrier gas route GP by an inner peripheral surface of the second sleeve 48 of the casing member 40 and an outer peripheral surface of the tubular portion with smaller inner diameter 93 of the protecting member 91. The cylindrical branch air channel 97 communicates to outside via a penetrating hole 98 provided along a surrounding surface of the needle electrode 90. Specifically, the air passing through the carrier gas route GP in the casing member 40 passes through each cylindrical branch air channel 97 and each penetrating hole 98 that are branched so as to perpendicularly intersect with the carrier gas route GP extending traversely along the longitudinal direction of the main body casing 10, and is discharged to outside from about each needle electrode 90.

In attaching the electrode assembly 92 to the casing member 40, a protrusion 52 is provided for the outer peripheral surface of the second sleeve 48 of the casing member 40, as shown in FIG. 5. On the other hand, it is preferable to provide the incline slit 99 that receives the protrusion 52 for the tubular portion with larger outer diameter 95 of the electrode assembly 92, as shown in FIG. 21. By pushing the electrode assembly 92 with the protrusion 52 is in the incline slit 99, it is possible to assemble the electrode assembly 92 and the needle electrode 90 to the casing member 40 while positioning.

According to the above configuration, when the electrode assembly 92 is attached to the casing member 40, the contact segment 59 of the high voltage plate 50 is pressed to the upper end surface of the needle electrode 90 and becomes conductive. A region including the contact portion of the needle electrode 90 and the contact segment 59 forms a space communicating to the carrier gas route GP and the cylindrical branch air channel 97 of the casing member 40, by the tip end portion of the tubular portion with smaller inner diameter 93 of the electrode assembly 92 fitting into the first sleeve 56 of the supporting plate 55.

The electrode assembly 92 holds the needle electrode 90, and the rear end portion of the needle electrode 90 protrudes more than the rear end portion of the electrode assembly 92 to contact with the high voltage plate 50. On the other hand, the carrier gas is sent from the carrier gas route GP through the cylindrical branch air channel 97 and through the penetrating hole 98, to the tip end portion of the electrode assembly 92 provided with the tip end of the needle electrode 90, and discharged to outside therefrom.

An air discharge outlet for discharging the carrier gas can be such that the needle electrode 90 is sealed at the tubular portion with smaller inner diameter and the air may be discharged from a penetrating hole opening to its surroundings. In this case, the penetrating hole is formed separately from a portion at which a tip end portion of the needle electrode 90 is exposed to the external air, and the penetrating hole is provided at a position spaced radially centering the tip end portion of the needle electrode 90. However, the present invention is not limited to this example, and it is also possible to send the carrier gas along the needle electrode without sealing around the needle electrode.

The needle electrode 90 is made of tungsten. The needle electrode 90 wears away as time passes, and fine particles of worn tungsten circulate in the air. However, in using the ionization device in a clean room in which silicone wafers and such are manufactured, fine foreign particles of such as tungsten attaching to a silicone wafer is not desirable in terms with properties of a wafer. Accordingly, by forming the needle electrode with silicone, the problem can be eliminated since the silicone particles attaches to the silicone wafer made of the same material even when worn fine particles circulate in the air. However, there is a problem that a silicone needle electrode is hard but fragile. Therefore, there is a risk that the needle electrode can be damaged when the needle electrode is fixed to the electrode assembly. In order to avoid such a problem, the tip end of the needle electrode is made of silicone, and the rear end thereof to be fixed to the electrode assembly is made of stainless steel. By electrically connecting these two ends, it is possible to use the silicone needle electrode for corona discharge and use the stainless steel needle electrode for fixation.

(Block Diagram)

Figure 22:
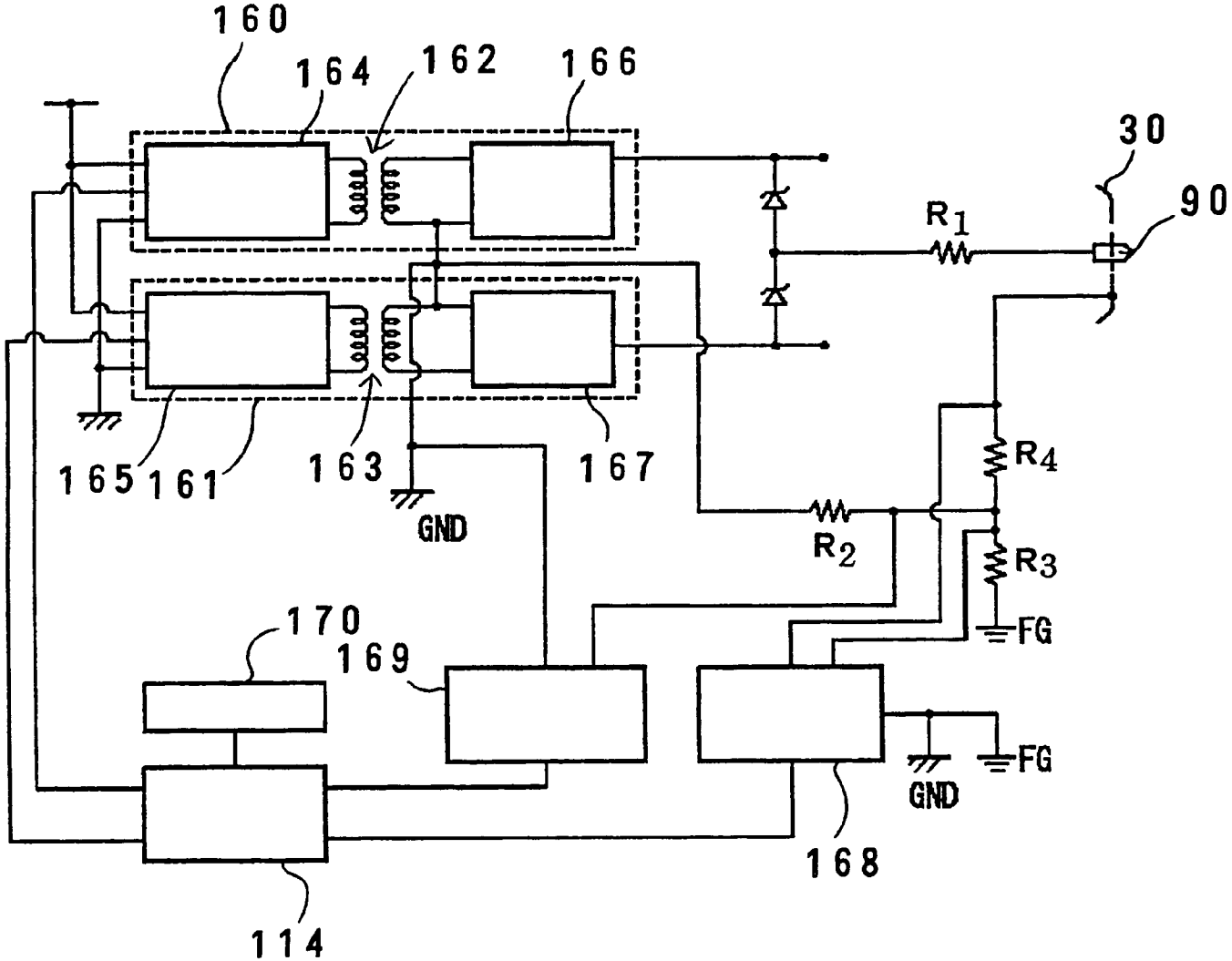
FIG. 22 shows a block diagram of a control circuit of the ionization device.
Figure 23:
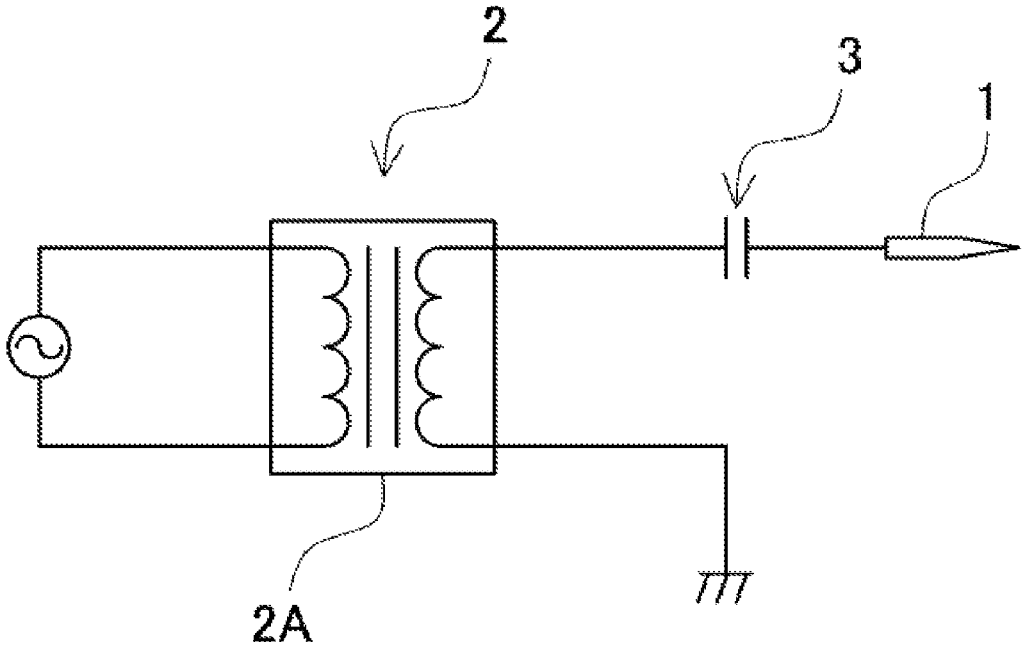
FIG. 23 shows a circuit diagram illustrating a configuration of an electricity removing device.
Figure 24:
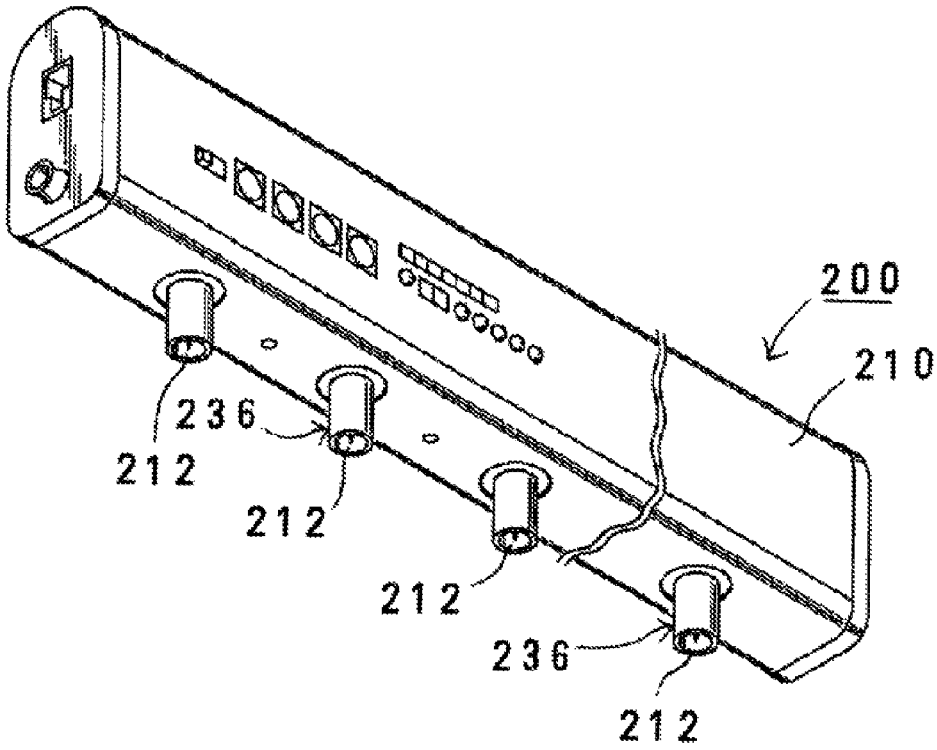
FIG. 24 shows a perspective view illustrating an external appearance of a conventional ionization device.
Figure 25:
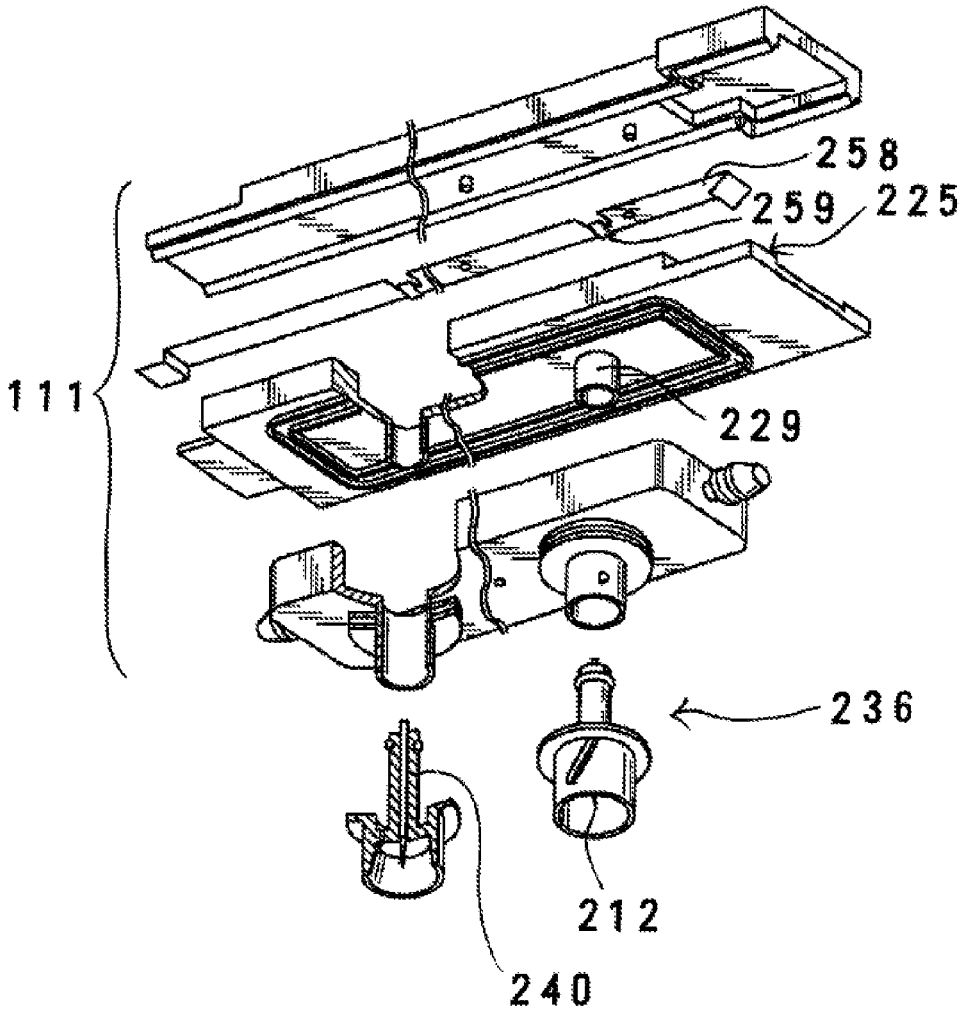
FIG. 25 shows an exploded perspective view of the ionization device illustrated in FIG. 2.
Figure 26:
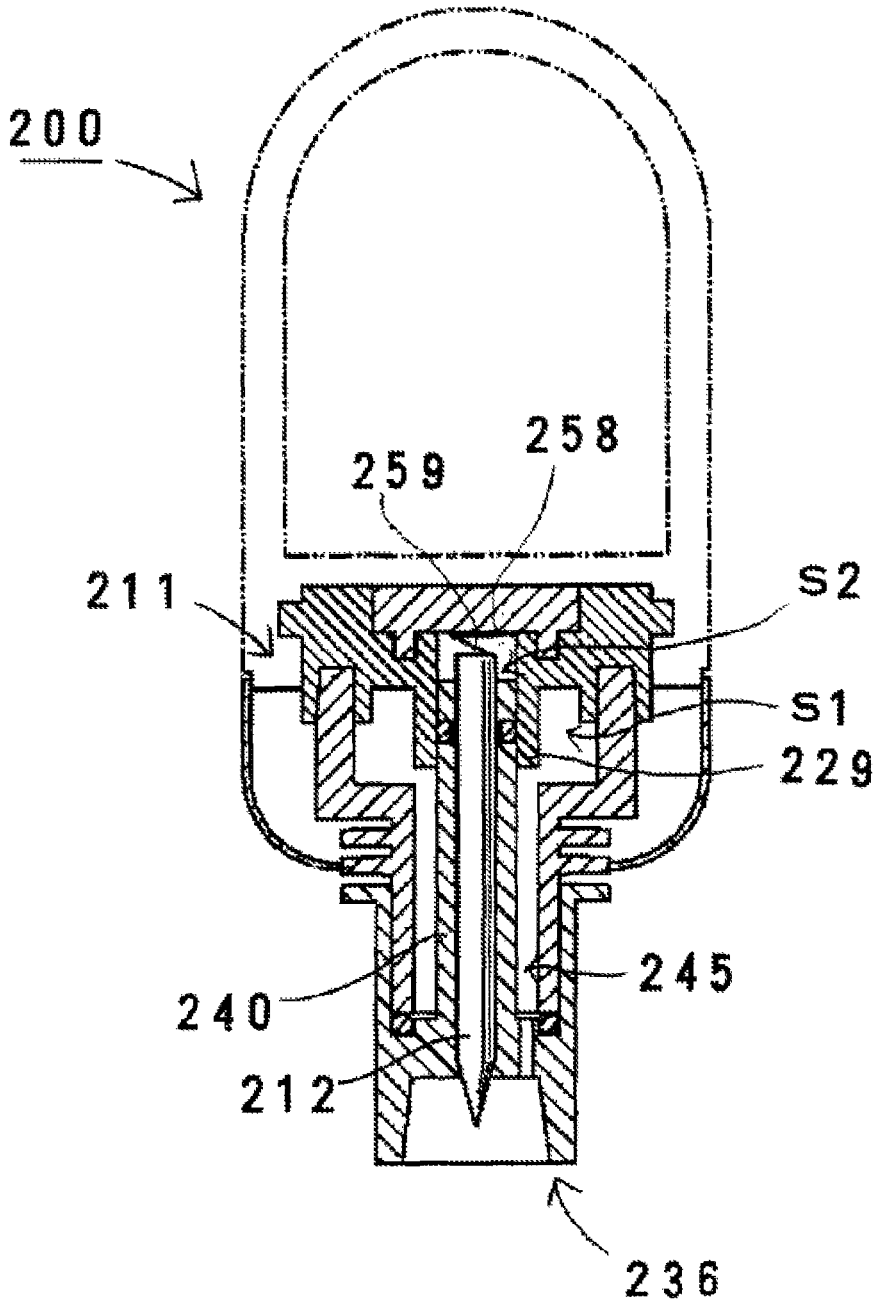
FIG. 26 shows a cross-sectional view of the ionization device illustrated in FIG. 2.
Figure 27:
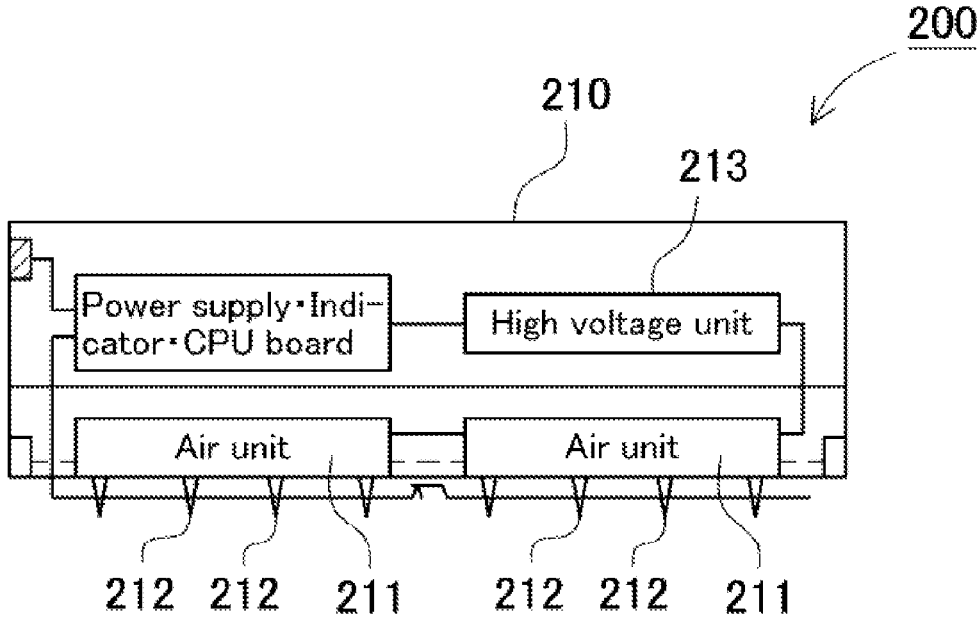
FIG. 27 shows a block diagram illustrating an internal structure of the ionization device illustrated in FIG. 2.

The control unit 82 including the control circuit is incorporated in a main body of the ionization device. The control circuit of the ionization device is shown in a block diagram of FIG. 22. FIG. 22 schematically shows the control circuit of the ionization device. The ionization device employs pulse AC ion generating system in which positive ions and negative ions are alternatively generated from the same needle electrode 90. The ionization device includes a positive high voltage generating circuit 160 and a negative high voltage generating circuit 161, and the power unit 81 is constituted from these high voltage generating circuits 160 and 161. The power unit 81 is housed in a sealed box. The positive high voltage generating circuit 160 an the negative high voltage generating circuit 161 are both include self-oscillation circuits 164 and 165 connected to primary coils of transformers 162 and 163 and booster circuits 166 and 167 connected to secondary coils and respectively configured by, for example, double rectification circuits. A protective resistance, i.e. a first resistance R1 is provided between the high voltage generating circuits 160 and 161 and the needle electrode 90. A second resistance R2 and a third resistance R3 are serially connected between a ground terminal GND and a field ground FG of the secondary coils of the transformers 162 and 163, and a fourth resistance R4 and the third resistance R3 are serially connected between the covering portion 30 that constitutes the counter electrode plate and the field ground FG.

An ion balance in the vicinity of the needle electrode 90 can be known by detecting current flowing through the fourth resistance R4 using an ion current detection circuit 168. Further, An ion balance in the vicinity of the work can be known by detecting current flowing through the third resistance R3 using the ion current detection circuit 168. Moreover, by detecting current flowing through the second resistance R2 using an abnormal electrical discharge current detection circuit 169, it is possible to detect abnormal electrical discharge between the needle electrode 90 and the covering portion 30 that constitutes the counter electrode plate or the field ground FG. When a CPU 114 determines that there is abnormal electrical discharge, an operator may be notified of such abnormality by turning on an indicator LED 170 serving as an alarming unit. Furthermore, while a voltage value of one of the positive high voltage generating circuit 160 and the negative high voltage generating circuit 161 is fixed and a voltage value of the other is variable in this example, the both voltage values can be variable.

As described above, the explanation is given about the circuits in the pulse AC ionization device. However, the power supply of the ionization device can be either AC or DC.

For example, an SSDC system in which positive ions and negative ions are generated at the same time can be employed, or a pulse DC system in which positive ions and negative ions are generated alternatively can be employed.

Moreover, it is possible to use a plurality of the ionization devices coupled via a cable. The side cover 20 is provided with a coupling port with which the ionization device is coupled with another ionization device. Another ionization device can be coupled to the coupling port via a cable, to use the plurality of the ionization devices synchronously. In this case, the control unit 82 can detect that the plurality of the ionization devices are connected, and control the ionization devices in conjunction with one another. The ionization devices to be coupled may be either of the same type, or of different types, such as with different lengths and different numbers of the needle electrodes.

While the above ionization device is configured to incorporate the control unit 82 as a controller, the control unit may be external. Specifically, a controller incorporating a control unit is configured as an independent external unit from the ionization device, and connecting the controller to the ionization device via a cable.

The ionization device 100 supplies high voltage generated by the power unit 81 to each needle electrode 90 of the ionization device 100 via the high voltage plate 50, and ionizes the air by the corona discharge to emit the ions from the tip end of the needle. Moreover, the ionization device 100 discharges the carrier gas from about the needle electrodes 90 in order to carry the ions generated by the needle electrode 90 far. By discharging the carrier gas from about each needle electrode 90, the ionized air around the tip end of the needle electrode 90 is forcibly sent downward toward the object item for removal of electricity (work), to remove electricity from the work. In this manner, the ionization device exhibits an excellent electricity removal by sending the ions without fail by a down flow mechanism utilizing the air.

An ionization device according to the present invention can be suitably used as an electricity remover for such as ionizer that controls static electricity in the air or that removes electricity of an electrically-charged work.

This application is based on Japanese Patent Application No. 2006-323596, filed on Nov. 30, 2006, the contents of which are incorporated hereinto by reference.

What is claimed is:

1. An ionization device comprising:

a plurality of needle electrodes, each of the needle electrodes emitting ions charged either positively or negatively from a tip end thereof by applying a high voltage thereto;

an electrical circuit unit for applying high voltage to the needle electrodes;

casing members formed in an elongated unit, each of said casing members including a high voltage plate for receiving a power supply from the electrical circuit unit, and being attachable with the plurality of the needle electrodes and spaced from each other, the casing members applying the high voltage supplied from the electrical circuit unit via the high voltage plate to the respective needle electrodes;

a coupling member for mechanically coupling adjacent casing members in a longitudinal direction and electrically connecting the high voltage plates of the respective casing members; and an elongated main body casing for housing the plurality of casing members with the coupling member and the electrical circuit unit, the main body casing having the needle electrodes spaced from each other in the longitudinal direction and protruding outside thereof, wherein the main body casing integrally forms a space for arranging the casing members so as to be separated from a space for arranging the electrical circuit unit, and wherein said coupling member includes a power supply joint for separately supplying the high voltage generated by the electrical circuit unit to the high voltage plate included in the casing member at a middle portion of the main body casing other than through the other casing members.

2. The ionization device according to claim 1, wherein the main body casing is divided into a first casing and a second casing, the first casing includes a portion having an integrally formed square cross-section with one side open, and a first wall surface integrally extending from one end of a rear surface of the portion having the square cross-section with one side open, the second casing includes a second wall surface in contact with the rear surface of the portion having the square cross-section with one side open, and in contact with a tip end of the first wall surface, and in a state in which the first casing and the second casing are fitted together, the casing body is arranged in a first space defined by the portion having the square cross-section with one side open, and the electrical circuit unit is arranged in a second space defined by the rear surface of the portion having the square cross-section with one side open, the first wall surface, and an inner side of the second wall surface.

3. The ionization device according to claim 1, wherein the casing member further includes a carrier gas route for supplying a carrier gas, in order to send the carrier gas from around the needle electrodes for carrying ions emitted from the needle electrodes, the main body casing further includes a middle carrier gas piping for supplying the carrier gas to at least one of the casing members positioned at a middle portion in the main body casing, the carrier gas is supplied to the carrier gas route from an end portion of the main body casing for the casing members positioned at an end portion in the main body casing, and the carrier gas is separately supplied via the middle carrier gas piping for the casing members positioned at the middle portion in the main body casing.

4. The ionization device according to claim 3, wherein the middle carrier gas piping comprises a hard pipe.

5. The ionization device according to claim 4, wherein another coupling member is provided that comprises a standard joint for inserting and pulling the casing members so as to couple the casing members along the longitudinal direction of the main body casing.

6. The ionization device according to claim 5, further comprising a carrier gas supply joint for connecting the middle carrier gas piping.

7. The ionization device according to claim 1, further comprising:

a metal covering portion for covering an outer periphery of the main body casing, wherein the covering portion has a square cross-section with one side open and is integrally formed by extending along the longitudinal direction of the main body casing, the main body casing being inserted into an opening of the square with one side open, thereby elastically pressing and holding the main body casing.

8. The ionization device according to claim 1, wherein the electrical circuit unit is positioned at an end portion in the longitudinal direction in the main body casing.

9. The ionization device according to claim 8, wherein the electrical circuit unit includes a power unit having a power supply circuit connected to an external power source, a control unit having a control circuit, and a booster unit having a booster circuit for boosting voltage, each of which is constituted in a unit form.

10. The ionization device according to claim 3, wherein the electrical circuit unit is arranged at one end in the main body casing, and the middle carrier gas piping is arranged at the other end.

11. The ionization device according to claim 1, wherein the main body casing has a length in a range from 1.0 m to 4.0 m.

12. An ionization device comprising:

a plurality of needle electrodes, each of the needle electrodes emitting ions charged either positively or negatively from a tip end thereof by applying a high voltage thereto;

an electrical circuit unit for applying high voltage to the needle electrodes;

a plurality of casing members formed in an elongated unit, each of said casing members including a high voltage plate disposed along a longitudinal direction of the casing member from one end portion to another end portion of the casing member for receiving power supply from the electrical circuit unit and a gas passage extending along the longitudinal direction of the casing member from the one end portion to the another end portion of the casing member and being separated from the high voltage plate, and each casing member having the plurality of needle electrodes being spaced from each other along the longitudinal direction of the casing member and for applying the high voltage supplied from the electrical circuit unit via the high voltage plate to the respective needle electrodes;

a coupling member for mechanically coupling the gas passages of adjacent two casing members in the longitudinal direction and electrically connecting the high voltage plates of the respective casing members; and an elongated main body casing having a first space and a second space separated from the first space along the longitudinal direction and for housing a casing body comprising the plurality of casing members with the coupling member and the electrical circuit unit, the main body casing integrally forms a space for arranging the casing body so as to be separated from a space for arranging the electrical circuit unit;

wherein the coupling member is disposed at an intermediate portion of the elongated main body casing and having an opening for connecting to at least one gas passage of the casing members; and a gas supply piping for separately supplying gas to the coupling member disposed at the intermediate portion of the elongated main body casing other than through the other casing members.

13. The ionization device according to claim 12, wherein the coupling member is disposed at an intermediate portion of the elongated main body casing having the opening for connecting to the two gas passages of the casing members.

14. The ionization device according to claim 12, further comprising a first gas supply port disposed at one end portion of the elongated main body casing along the longitudinal direction for supplying gas to the gas passage of one casing member adjacent to the one end portion of the elongated main body casing.

15. The ionization device according to claim 14, further comprising a second supply port disposed at another end portion of the elongated main body casing along the longitudinal direction for supplying gas to the gas passage of the other casing member adjacent to the another end portion of the elongated main body casing.

16. The ionization device according to claim 15, further comprising a third gas supply port disposed at either the one end portion or the another end portion of the elongated main body casing for connecting the gas supply piping.

17. The ionization device according to claim 12, further comprising a power supply joint for separately supplying the high voltage generated by the electrical circuit unit to a high voltage plate included in the casing member at a middle portion of the main body casing other than through the casing members.

* * * * *